US006384802B1

(12) United States Patent
Moon

(10) Patent No.: US 6,384,802 B1
(45) Date of Patent: May 7, 2002

(54) PLASMA DISPLAY PANEL AND APPARATUS AND METHOD FOR DRIVING THE SAME

(75) Inventor: Seong Hak Moon, Kyunggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/339,210

(22) Filed: Jun. 24, 1999

(30) Foreign Application Priority Data

| | | |
|---|---|---|
| Jun. 27, 1998 | (KR) | 98-24618 |
| Jun. 27, 1998 | (KR) | 98-24620 |
| Oct. 8, 1998 | (KR) | 98-42106 |
| Oct. 8, 1998 | (KR) | 98-42107 |

(51) Int. Cl.[7] ..... G09G 3/28
(52) U.S. Cl. ..... 345/60; 315/169.1
(58) Field of Search ..... 345/60, 63, 67–68, 345/55; 313/582, 584, 586; 315/169.1, 169.3, 169.4; 445/24; 348/441, 448, 445, 797

(56) References Cited

U.S. PATENT DOCUMENTS

| | | | | |
|---|---|---|---|---|
| 5,860,843 A | * | 1/1999 | Kasahara | 445/24 |
| 6,091,380 A | * | 7/2000 | Hashimoto et al. | 345/60 |
| 6,107,978 A | * | 8/2000 | Nagaoka et al. | 345/60 |
| 6,140,984 A | * | 10/2000 | Kanazawa et al. | 345/67 |
| 6,157,354 A | * | 12/2000 | Amemiya | 345/60 |
| 6,181,305 B1 | * | 1/2001 | Nguyen et al. | 345/60 |
| 6,188,374 B1 | * | 2/2001 | Moon | 345/60 |
| 6,208,082 B1 | * | 3/2001 | Kim et al. | 315/169.1 |
| 6,236,380 B1 | * | 5/2001 | Wani et al. | 345/60 |

* cited by examiner

*Primary Examiner*—Richard Hjerpe
*Assistant Examiner*—Frances Nguyen
(74) *Attorney, Agent, or Firm*—Fleshner & Kim, LLP

(57) ABSTRACT

A plasma display panel and a driving method and apparatus that are capable of improving a brightness. A sustaining discharge is caused between scanning/sustaining electrodes formed at each of adjacent scanning lines after a data was written into scanning lines, thereby improving a brightness and a discharge efficiency.

29 Claims, 21 Drawing Sheets

PLASMA DISPLAY PANEL AND APPARATUS AND METHOD FOR DRIVING THE SAME

BACKGROUND OF THE INVENTION

1. Field of the Invention

This invention relates to a plasma display panel and a driving method and apparatus thereof, and more particularly to a plasma display panel and a driving method and apparatus that can improve a brightness.

2. Description of the Related Art

Generally, a plasma display panel(PDP) radiates a fluorescent body by an ultraviolet with a wavelength of 147 nm generated during a discharge of He+Xe or Ne+Xe gas to thereby display a picture including characters and graphics. Such a PDP permits it to be easily made into a thin film and large-dimension type. Moreover, the PDP provides a very improved picture quality owing to a recent technical development. The PDP can be classified into an alternating current(AC) driving system making a surface discharge and a direct current(DC) driving system in accordance with its driving system.

Referring to FIG. 1, there is shown a PDP driving apparatus of AC system that includes a PDP 10 having a pixel matrix consisting of mxn discharge cells 1. In the PDP 10, m scanning/sustaining electrode lines Y1 to Ym and m common sustaining electrode lines Z1 to Zm are alternately formed, in parallel, on an upper substrate(not shown). Also, n address electrode lines X1 to Xn are formed on a lower substrate(not shown) in a direction perpendicular to the scanning/sustaining electrode lines Y1 to Ym and the common sustaining electrode lines Z1 to Zm. Each of the mxn discharge cells 1 is arranged in a matrix pattern at intersections among the scanning/sustaining electrode lines Y1 to Ym, the common sustaining electrode lines Z1 to Zm and the address electrode lines X1 to Xn. A barrier rib(not shown) is formed on the lower substrate in parallel with the address electrode lines XX1 to Xn to divide the discharge cells 1 arranged at the vertical direction.

Further, the PDP driving apparatus of AC driving system includes first and second address drivers 6A and 6B connected to the address electrode lines X1 to Xn of the PDP 10, a scanning/sustaining driver 2 connected to the scanning/sustaining electrode lines Y1 to Ym of the PDP 10, and a common sustaining driver 4 connected to the common sustaining electrode lines Z1 to Zm of the PDP 10. The first address driver 6A is connected to odd-numbered address electrode lines X1, X3, . . . , Xn−3, Xn−1 and the second address driver 6B is connected to even-numbered X electrodes X2, X4, . . . , Xn−2, Xn to apply a video data to each address electrode line X1 to Xn. The scanning/sustaining driver 2 is connected to m scanning/sustaining electrode lines Y1 to Ym to select a scanning line to be displayed and to cause a sustaining discharge at the displayed scanning line. The common sustaining driver 4 is commonly connected to m common sustaining electrode lines Z1 to Zm to apply an identical waveform of voltage signal to all the common sustaining electrode lines Z1 to Zm, thereby causing a sustaining discharge.

In such a PDP, one frame consists of a number of sub-fields, and a gray level is realized by a combination of the sub-fields. For instance, when it is intended to realize 256 gray levels, one frame interval is time-divided into 8 sub-fields. Further, each of the 8 sub-fields is again divided into an address interval and a sustaining interval. A discharge initiated at each of the discharge cells selected in the address interval is sustained during the sustaining interval.

The sustaining interval is lengthened by an interval corresponding to $2^n$ depending on a weighting value of each sub-field. In other words, the sustaining interval involved in each of first to eighth sub-fields increases at a ratio of $2^0$, $2^1$, $2^3$, $2^4$, $2^5$, $2^6$ and $2^7$. To this end, the number of sustaining pulses generated in the sustaining interval also increases into $2^0$, $2^1$, $2^3$, $2^4$, $2^5$, $2^6$ and $2^7$ depending on the sub-fields. A brightness and a chrominance of a displayed image are determined in accordance with a combination of the sub-fields.

However, the PDP shown in FIG. 1 has a problem in that, since it causes a discharge within a discharge area provided in a minute size of discharge cell 1, its brightness and its discharge efficiency is low. More specifically, the PDP allows a negative glow discharge to lead the entire luminescence. The negative glow discharge results in a low brightness because a luminescence occurs in an ionized process. On the other hand, a luminescence occurring upon positive column discharge is leaded by a luminescence caused by an excitation, the brightness becomes very high. In a PDP having a very small independent discharge area, the positive column discharge area becomes small within each discharge area.

FIG. 2 shows brightness of adjacent discharge cells 1A and 1B shown in FIG. 1. When an A discharge cell 1A and a B discharge cell 1B arranged in the adjacent scanning lines are discharged, each discharge cell 1A and 1B is emitted at the glow discharge area. At this time, the brightness of the A discharge cell 1A and the B discharge cell 1B has a maximum value within each discharge area while having a minimum value in their boundary. Accordingly, even when all the two adjacent discharge cells 1A and 1B are discharged, a sufficient brightness is not provided. A scheme of increasing a size of the discharge area enough to enlarge the positive column area may be considered, but a size of each discharge cell and therefore a size of the discharge area must be limited so as to meet a desired resolution within a certain screen dimension. Accordingly, since the discharge area is reduced so much that the numbers of lines and discharge cells becomes larger as a resolution becomes higher, a brightness and a discharge efficiency are more deteriorated.

A scheme for improving a brightness by reducing the number of sustaining electrode lines has been disclosed in Japanese Patent Laid-open Gazette No. Pyung 9-16050. The PDP shown in FIG. 1 requires 2 m electrode lines, i.e., m scanning/sustaining electrode lines Y1 to Ym and m common sustaining electrode lines while the suggested PDP requires only a total (m−1) scanning electrode lines and a sustaining electrode line with respect to m scanning lines.

The suggested PDP is driven in the interlacing system for displaying a picture by constructing one frame by a number of sub-fields, each of which is divided into odd-numbered fields and even-numbered fields. In the odd-numbered fields, an address discharge is caused by applying data pulses corresponding to only the odd-numbered scanning lines to the address electrode lines and, at the same time, applying scanning pulses to (m/2)−1 scanning electrode lines arranged between m/2 sustaining electrode lines. In the sustaining interval, a sustaining discharge is generated between the corresponding scanning electrode line and the adjacent sustaining electrode lines. Then, in the even-numbered fields, an address discharge is generated by applying data pulses corresponding to only the even-numbered scanning lines to the address electrode lines and, at the same time, applying scanning pulses sequentially to the scanning electrode lines. In the sustaining interval, a sustaining discharge is generated between the corresponding scanning electrode line and the adjacent sustaining electrode lines.

As described above, the suggested PDP reduces the number of sustaining electrode lines into a half of that in the prior art to lengthen a length between the scanning electrode lines, so that it can improve a brightness and a discharge efficiency. Also, according to the suggested PDP, since the number of electrode lines is reduced, it has been expected as a strategy favorable to an implementation of high resolution. However, the suggested PDP has a drawback in that, since it can be applied to only a display device of interlace system such as television, its application range must be limited. Therefore, the suggested PDP fails to be applied to a display device of progressive system which is forecast to be largely employed as a driving system for a display device having a resolution of the high definition(HD) class.

SUMMARY OF THE INVENTION

Accordingly, it is an object of the present invention to provide a PDP and a driving method and apparatus thereof that are capable of improving a brightness as well as a discharge efficiency.

Further object of the present invention is to provide a PDP and a driving method and apparatus thereof that are applicable to an interlace system as well as a progressive system.

In order to achieve these and other objects of the invention, a plasma display panel according to one aspect of the present invention includes scanning/sustaining electrodes formed at each of scanning lines; and common sustaining electrodes formed at the scanning lines, wherein said scanning/sustaining electrodes are arranged adjacently to other scanning/sustaining electrodes formed at the adjacent scanning lines, said common sustaining electrodes are arranged adjacently to other common sustaining electrodes formed at the adjacent scanning lines.

In a plasma display panel according to another aspect of the present invention, and each of m scanning lines is provided with an address electrode supplied with a data and a scanning/sustaining electrode for performing a scanning and a sustaining discharge.

A driving apparatus for a plasma display panel according to still another aspect of the present invention includes a display panel arranged in such a manner that scanning/sustaining electrodes formed at each of adjacent scanning lines is adjacent to each other and in such a manner that common sustaining electrodes formed at each of the adjacent scanning lines is adjacent to each other; and driving means for generating a sustaining discharge between the scanning/sustaining electrode and the common sustaining electrode formed at each of the adjacent scanning lines.

A driving apparatus for a plasma display panel according to still another aspect of the present invention includes a display panel in which each of the scanning lines is provided with an address electrode supplied with a data and an scanning/sustaining electrode for performing a scanning and a sustaining discharge; and driving means for causing a sustaining discharge between the scanning/sustaining electrodes formed at each of adjacent scanning lines.

A method of driving a plasma display panel according to still another aspect of the present invention includes the steps of writing a data into m scanning lines; and causing a sustaining discharge between the scanning/sustaining electrodes formed at each of the adjacent scanning lines.

A method of driving a plasma display panel according to still another aspect of the present invention includes the steps of applying an inverse phase of pulse signals to scanning/sustaining electrodes and common sustaining electrodes formed at each of adjacent scanning lines; and applying pulse signals having a phase difference corresponding to a pulse width between the scanning/sustaining electrodes and the common sustaining electrodes formed at the same scanning line to shut off a discharge within the same scanning line.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
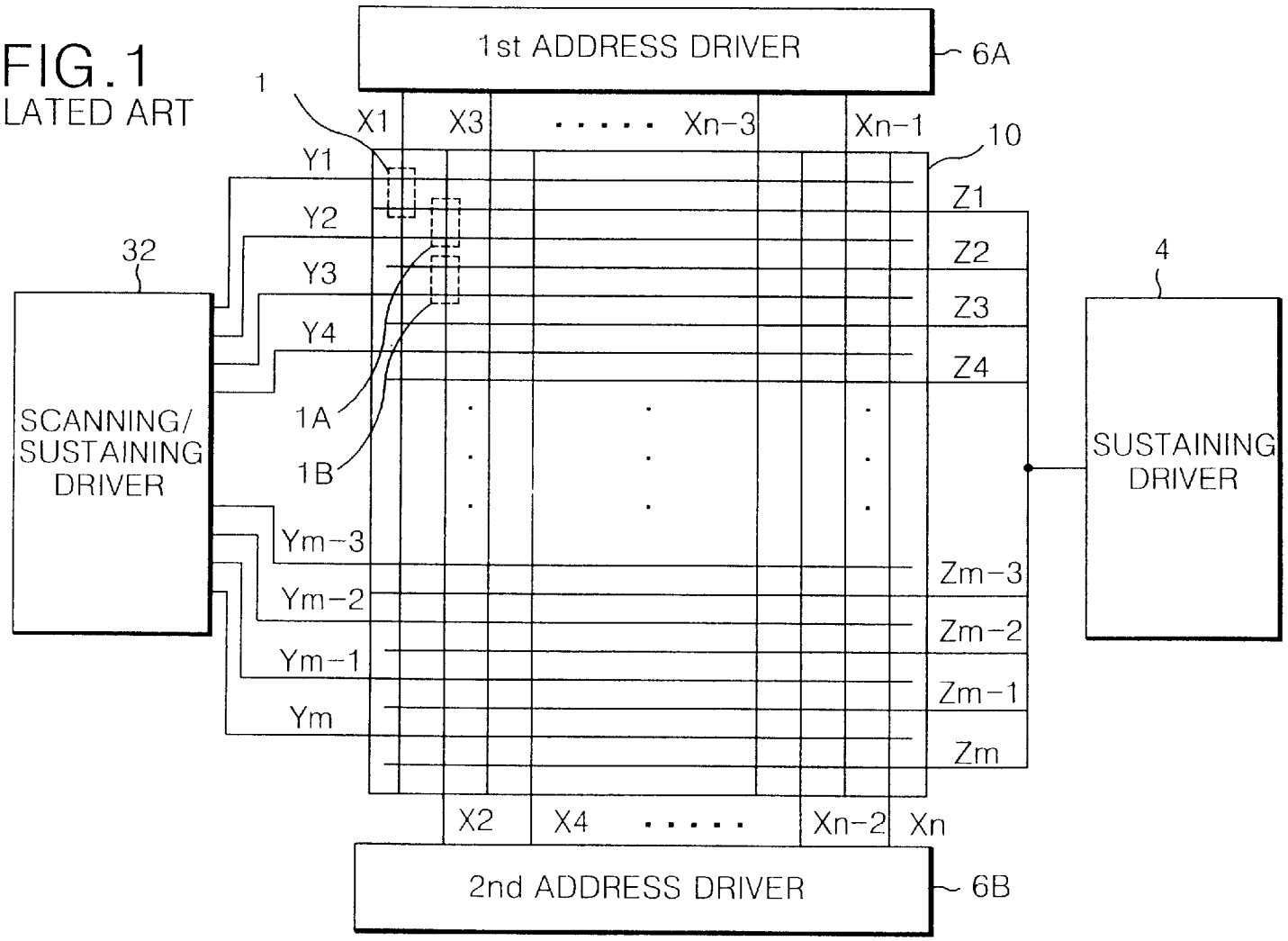
FIG. 1 RELATED ART
FIG. 1 is a schematic view showing the configuration of a conventional PDP driving apparatus of AC driving system.
Figure 2:
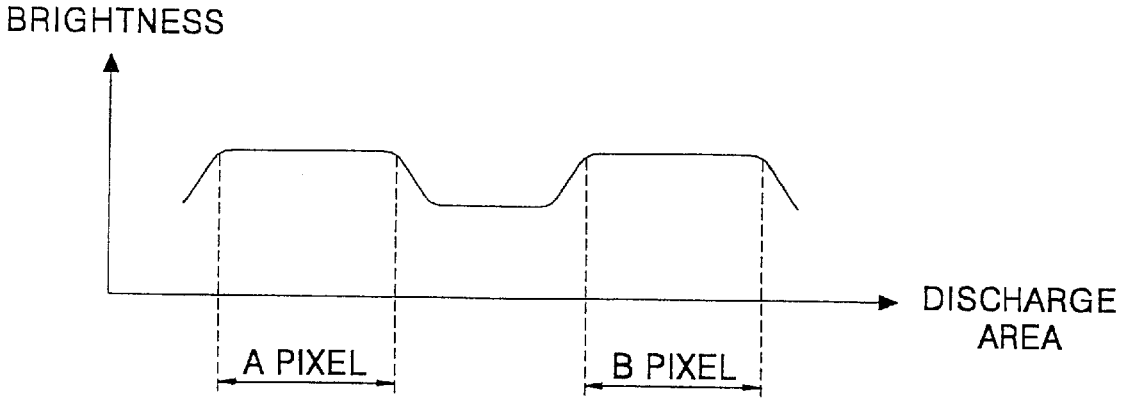
FIG.2 RELATED ART
FIG. 2 is a graph showing a brightness distribution of the adjacent discharge cells in FIG. 1.
Figure 3:
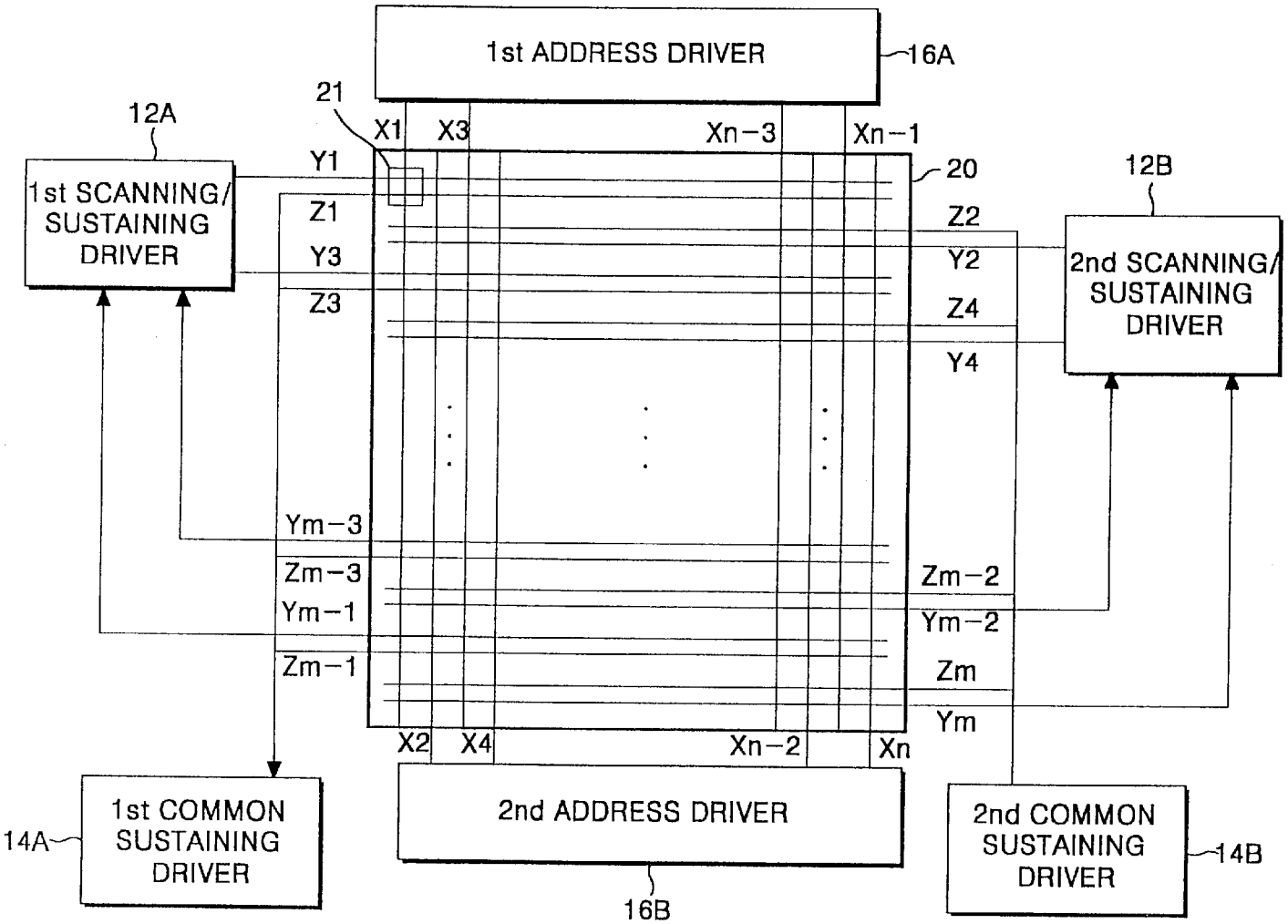
FIG. 3 is a schematic view showing the configuration of a PDP driving apparatus according to a first embodiment of the present invention.

Referring to FIG. 3, there is shown a PDP driving apparatus according to a first embodiment of the present invention that includes a PDP 20 having a discharge cell matrix consisting of mxn discharge cells 21. In the PDP 20, m scanning/sustaining electrode lines Y1 to Ym and m common sustaining electrode lines Z1 to Zm are formed, in parallel, on an upper substrate. Herein, in odd-numbered scanning lines, odd-numbered scanning/sustaining electrode lines Yodd, i.e., Y1, Y3, . . . , Ym−3, Ym−1 are arranged at the upper portion and odd-numbered common sustaining electrode lines Zodd, i.e., Z1, Z3, . . . , Zm−3, Zm−1 are arranged at the lower portion. On the other hand, in even-numbered scanning lines, even-numbered common sustaining electrode lines Zeven, i.e., Z2, Z4, . . . , Zm−2, Zm are arranged at the upper portion and even-numbered scanning/sustaining electrode lines Yeven, i.e., Y2, Y4, . . . , Ym−2, Ym are arranged at the lower portion. N address electrode lines X1 to Xn are formed on a lower substrate in a direction perpendicular to the scanning/sustaining electrode lines Y1 to Ym and the common sustaining electrode lines Z1 to Zm.

Each of the mxn discharge cells 21 is arranged in a matrix pattern at intersections among the scanning/sustaining electrode lines Y1 to Ym, the common sustaining electrode lines Z1 to Zm and the address electrode lines X1 to Xn. Meanwhile, a barrier rib(not shown) is formed on the lower substrate in parallel to the address electrode lines X1 to Xn to divide the discharge cells 21 standing at the vertical direction.

Further, the PDP driving apparatus according to a first embodiment of the present invention includes a first address driver 16A for applying a video data to the odd-numbered address electrode lines Xodd, i.e., X1, X3, . . . , Xn−3, Xn−1, a second address driver 16B for applying a video data to the even-numbered address electrode lines Xeven, i.e., X2, X4, . . . , Xn−2, Xn, a first scanning/sustaining driver 12A for driving the odd-numbered scanning/sustaining electrode lines Yodd, a second scanning/sustaining driver 12B for driving the even-numbered scanning/sustaining electrode lines Yeven, a first common sustaining driver 14A for driving the odd-numbered common sustaining electrode lines Zodd, and a second common sustaining driver 14B for driving the even-numbered common sustaining electrode lines Zeven. The first address driver 16A is synchronized with a scanning pulse applied to scanning lines to apply a video data to the odd-numbered address lines Xodd. The second address driver 16B is synchronized with a scanning pulse applied to the scanning lines to apply a video data to the even-numbered address lines Xeven. The first scanning/sustaining driver 12A is arranged at the left side of the PDP 20 to apply a reset pulse, a scanning pulse and a sustaining pulse sequentially to the odd-numbered scanning/sustaining electrode lines Yodd. The second scanning/sustaining driver 12B is arranged at the right side of the PDP 20 to apply a reset pulse, a scanning pulse and a sustaining pulse sequentially to the even-numbered scanning/sustaining electrode lines Yeven. The first common sustaining driver 14A is arranged at the left side of the PDP 20 to apply a reset pulse and a sustaining pulse to the odd-numbered common sustaining electrode lines Zodd. The second common sustaining driver 14B is arranged at the right side of the PDP 20 to apply a reset pulse and a sustaining pulse to the even-numbered common sustaining electrode lines Zeven.

Figure 4:
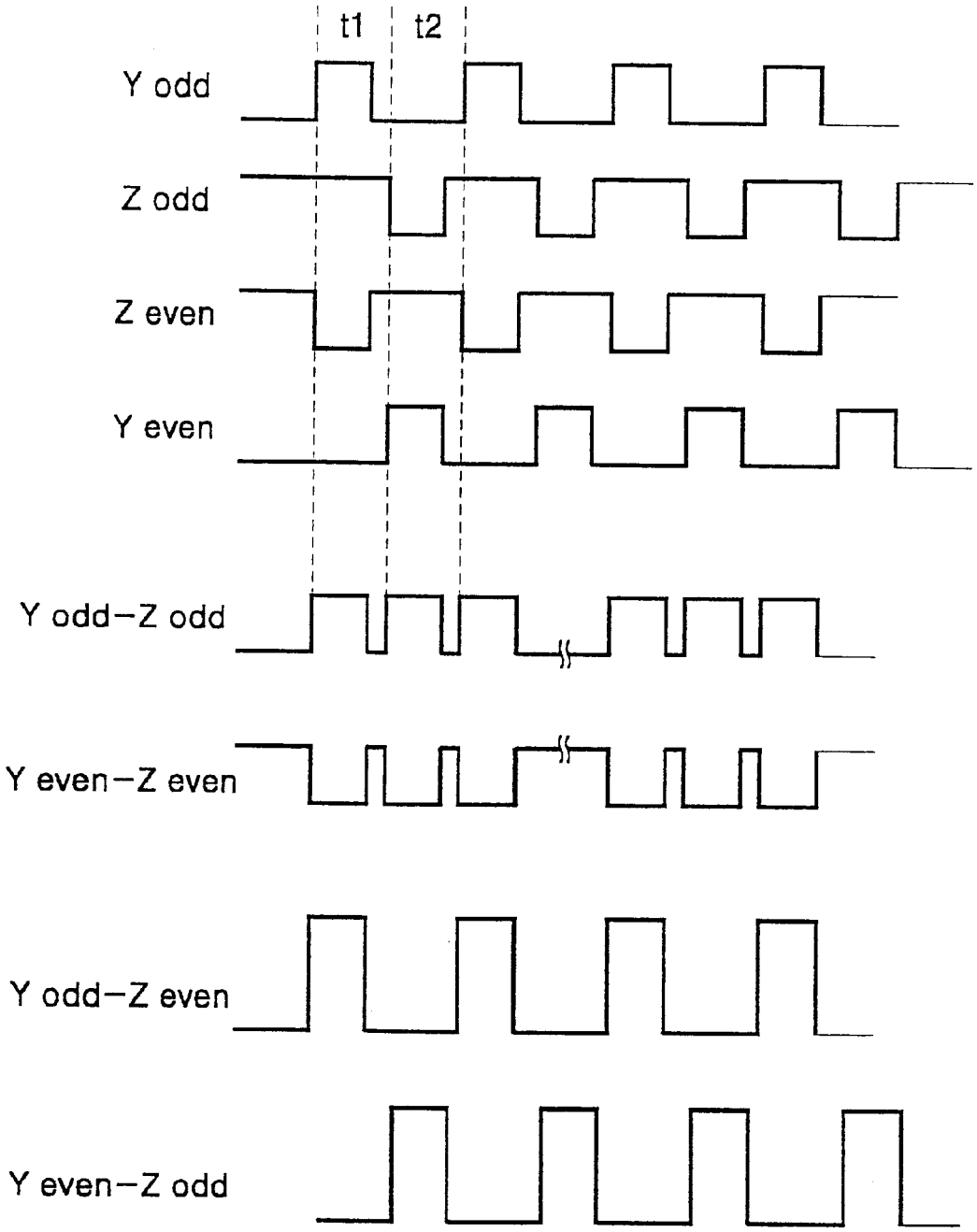
FIG. 4 is waveform diagrams of sustaining pulses in the PDP shown in FIG. 3.
Figure 5:
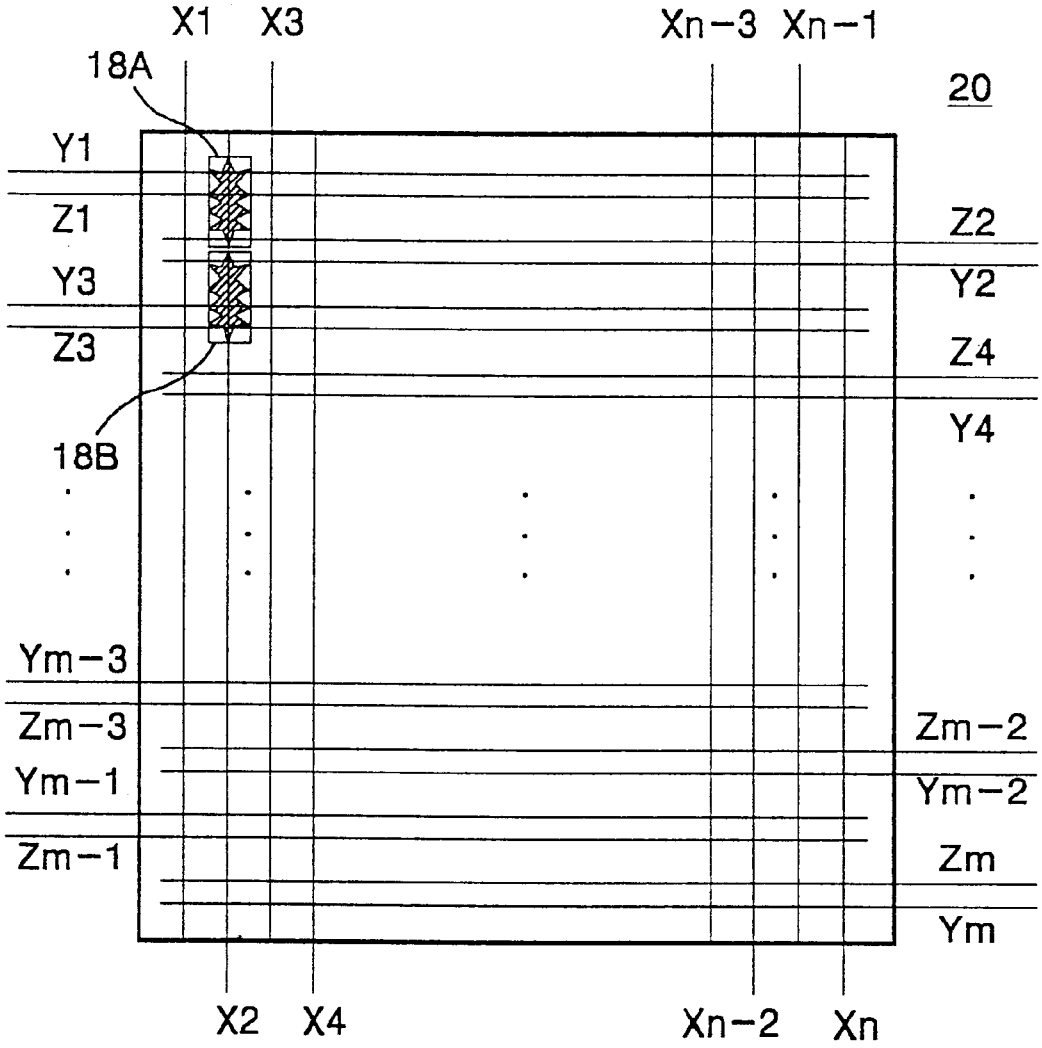
FIG. 5 is a schematic view showing discharge areas upon sustaining discharge of the PDP in FIG. 3.

FIG. 4 is waveform diagrams showing sustaining pulses of the PDP in FIG. 3, and which is explained in conjunction with FIG. 5 representing discharge areas. In an interval t1, an inverse phase of sustaining pulses are applied between the odd-numbered scanning/sustaining electrode lines Yodd and the even-numbered common sustaining electrode lines Zeven. At this time, a voltage difference Yodd-Zeven between the odd-numbered scanning/sustaining electrode lines Yodd and the even-numbered common sustaining electrode lines Zeven becomes more than a voltage level that can cause a discharge. In an interval t2, an inverse phase of sustaining pulses are applied between the even-numbered scanning/sustaining electrode lines Yeven and the odd-numbered common sustaining electrode lines Zodd. At this time, a voltage difference Yeven-Zodd between the even-numbered scanning/sustaining electrode lines Yeven and the odd-numbered common sustaining electrode lines Zodd becomes more than that causes a discharge.

On the other hand, the sustaining pulses applied to the odd-numbered scanning/sustaining electrode lines Yodd and the odd-numbered common sustaining electrode lines Zodd, or the even-numbered scanning/sustaining electrode lines Yeven and the even-numbered common sustaining electrode lines Zeven have a phase difference corresponding to one pulse width. Accordingly, a voltage difference Yodd-Zodd between the odd-numbered scanning/sustaining electrode lines Yodd and the odd-numbered common sustaining electrode lines Zodd and a voltage difference Yeven-Zeven between the even-numbered scanning/sustaining electrode lines Yeven and the even-numbered common sustaining electrode lines Zeven become less than a voltage level that can always cause a discharge.

Figure 6:
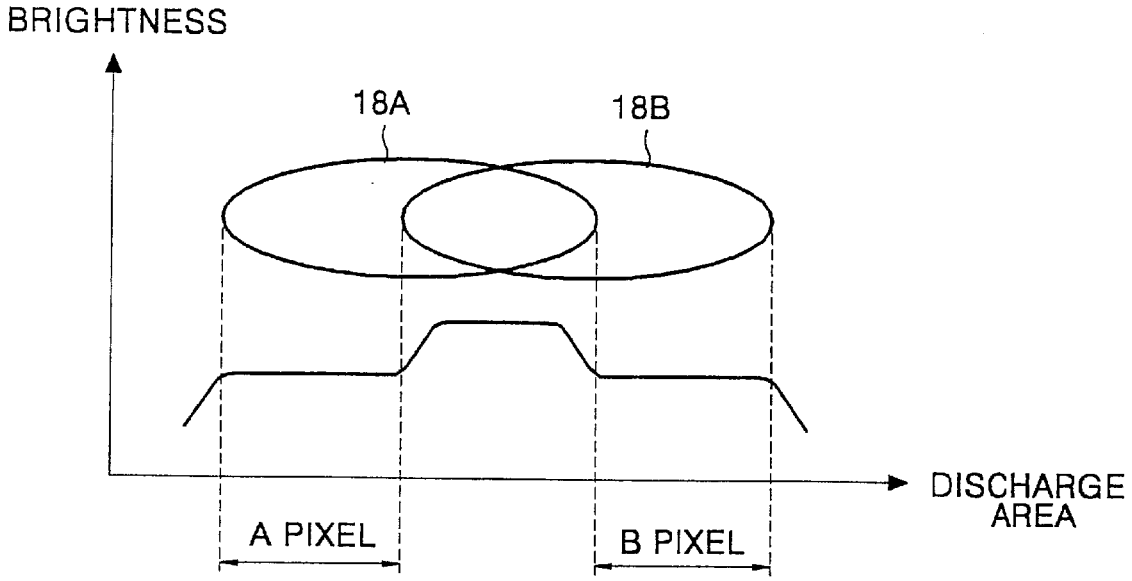
FIG. 6 is a graph showing a brightness distribution of the adjacent discharge cells in FIG. 5.

For instance, as shown in FIG. 5, the first scanning/sustaining electrode line Y1 and the second common sustaining electrode line Z2 are discharged in the t1 interval while the second scanning/sustaining electrode line Y2 and the third common sustaining electrode line Z3 are discharged in the t2 interval. Since the discharge areas 18A and 18B at this time include two scanning line width, a luminescence area is enlarged to that extent such that a luminescence is made until a positive column area. A luminescence distribution at the adjacent scanning lines is shown in FIG. 6. Specifically, when two adjacent discharge areas 18A and 18B are emitted, a brightness in a half area of the discharge cell overlapped with the luminous areas 18A and 18B is added to a brightness of each luminous areas 18A and 18B and therefore it is more enhanced.

Figure 7:
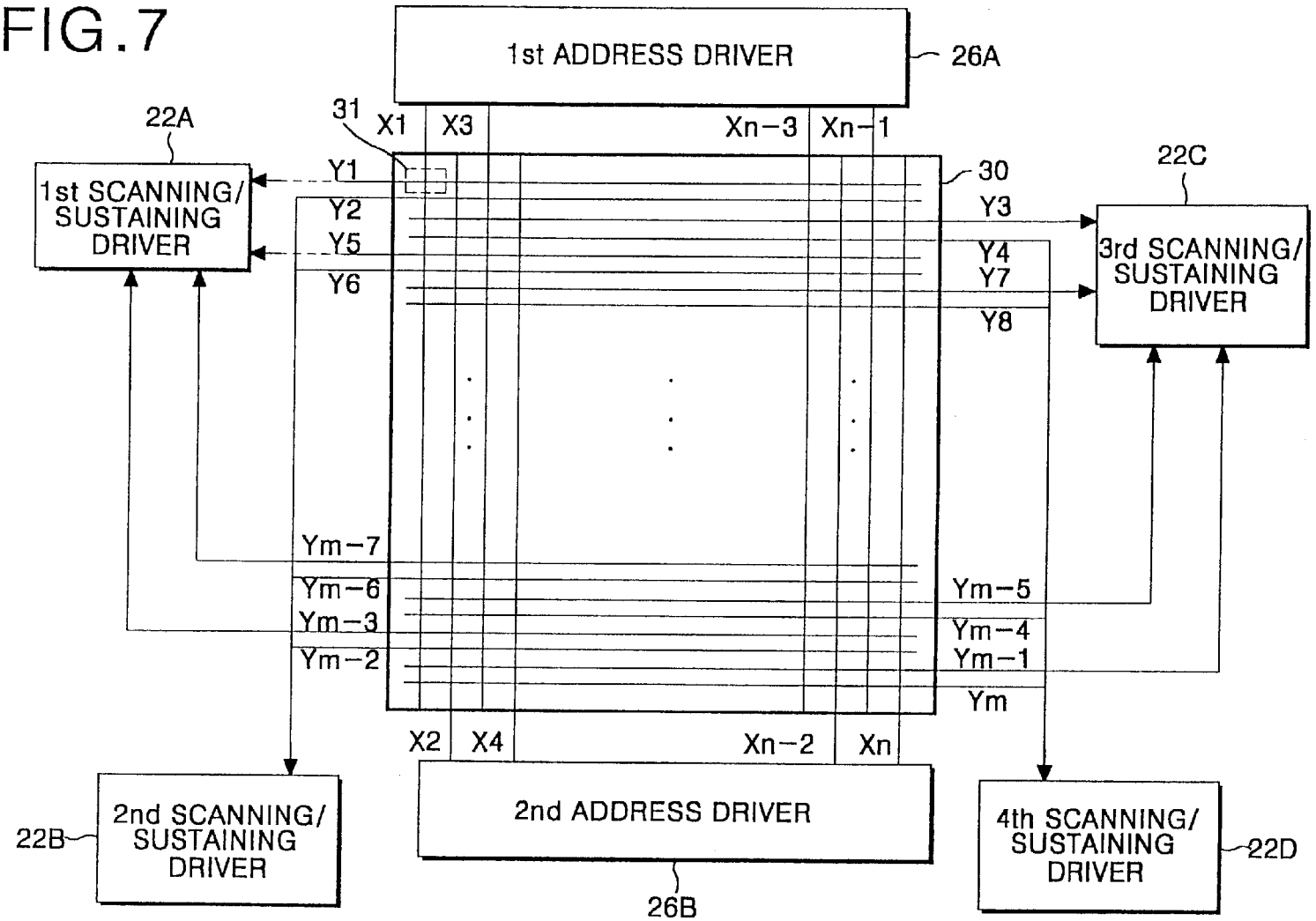
FIG. 7 is a schematic view showing the configuration of a PDP driving apparatus according to a second embodiment of the present invention.

Referring now to FIG. 7, there is shown a PDP driving apparatus according to a second embodiment of the present invention. The PDP driving apparatus includes a PDP 30 in which m scanning lines consists of m scanning/sustaining electrode lines Y1 to Ym and n address electrode lines X1 to Xn are crossed with the m scanning/sustaining electrode lines Y1 to Ym. Each of the mxn discharge cells 31 is arranged in a matrix pattern at intersections between the scanning/sustaining electrode lines Y1 to Ym and the address electrode lines X1 to Xn. A barrier rib(not shown) is formed in parallel to the address electrode lines X1 to Xn.

Further, the PDP driving apparatus according to a second embodiment of the present invention includes a first address driver 26A for applying a video data to the odd-numbered address electrode lines Xodd, i.e., X1, X3, . . . , Xn−3, Xn−1, a second address driver 26B for applying a video data to the even-numbered address electrode lines Xeven, i.e., X2, X4, . . . , Xn−2, Xn, a first scanning/sustaining driver 22A for driving (4k+1)th scanning/sustaining electrode lines Y(4k+1) (wherein k is an integer corresponding to $0 \leqq k < (m-4)/4$), i.e., Y1, Y5, . . . , Ym−7, Ym−3, a second scanning/sustaining driver 22B for driving (4k+2)th scanning/ sustaining electrode lines Y(4k+2), i.e., Y2, Y6, . . . , Ym−6, Ym−2, a third scanning/sustaining driver 22C for driving (4k+3)th scanning/sustaining electrode lines Y(4k+3), i.e., Y3, Y7, . . . , Ym−5, Ym−1, and a fourth scanning/sustaining driver 22D for driving (4k+4)th scanning/sustaining electrode lines Y(4k+4), i.e., Y4, Y8, . . . , Ym−4, Ym. The first address driver 26A is synchronized with a scanning pulse applied to scanning lines to apply a video data to the odd-numbered address lines Xodd. The second address driver 26B is synchronized with a scanning pulse applied to the scanning lines to apply a video data to the even-numbered address lines Xeven. The first scanning/sustaining driver 22A applies the scanning pulse synchronized with a video data to (4k+1)th scanning/sustaining electrode lines Y(4k+1) during an address interval to cause an address discharge between the (4k+1)th scanning/sustaining electrode lines Y(4k+1) and the address electrode lines X1 to Xn. The first scanning/sustaining driver 22A applies a sustaining pulse synchronized, in an inverse phase, with a sustaining pulse applied to the (4k+2)th scanning/sustaining electrode lines Y(4k+2) to the (4k+1)th scanning/sustaining electrode lines Y(4k+1) during a sustaining interval. The second scanning/sustaining driver 22B applies the scanning pulse synchronized with a video data to (4k+2)th scanning/sustaining electrode lines Y(4k+2) during an address interval to cause an address discharge between the (4k+2)th scanning/sustaining electrode lines Y(4k+2) and the address electrode lines X1 to Xn. The second scanning/sustaining driver 22B applies a sustaining pulse synchronized, in an inverse phase, with a sustaining pulse applied to the (4k+1)th scanning/sustaining electrode lines Y(4k+1) to the (4k+2)th scanning/sustaining electrode lines Y(4k+2) during a sustaining interval. The third scanning/sustaining driver 22C applies the scanning pulse synchronized with a video data to (4k+3)th scanning/sustaining electrode lines Y(4k+3) during an address interval to cause an address discharge between the (4k+3)th scanning/sustaining electrode lines Y(4k+3) and the address electrode lines X1 to Xn. The third scanning/sustaining driver 22C applies a sustaining pulse synchronized, in an inverse phase, with a sustaining pulse applied to the (4k+4)th scanning/sustaining electrode lines Y(4k+4) to the (4k+3)th scanning/sustaining electrode lines Y(4k+3) during a sustaining interval. The fourth scanning/sustaining driver 22D applies the scanning pulse synchronized with a video data to (4k+4)th scanning/sustaining electrode lines Y(4k+4) during an address interval to cause an address discharge between the (4k+4)th scanning/sustaining electrode lines Y(4k+4) and the address electrode lines X1 to Xn. The fourth scanning/sustaining driver 22D applies a sustaining pulse synchronized, in an inverse phase, with a sustaining pulse applied to the (4k+3)th scanning/sustaining electrode lines Y(4k+3) to the (4k+4)th scanning/sustaining electrode lines Y(4k+4) during a sustaining interval.

As a result, the first to fourth scanning/sustaining drivers 22A to 22D generate an address discharge between each scanning/sustaining electrode line Y1 to Ym included the corresponding scanning line and the address electrode lines X1 to Xn during an address interval. Then, the first to fourth scanning/sustaining drivers 22A to 22D generate a sustaining discharge between scanning/sustaining electrode lines Y1 to Ym included in the adjacent scanning lines.

Figure 8:
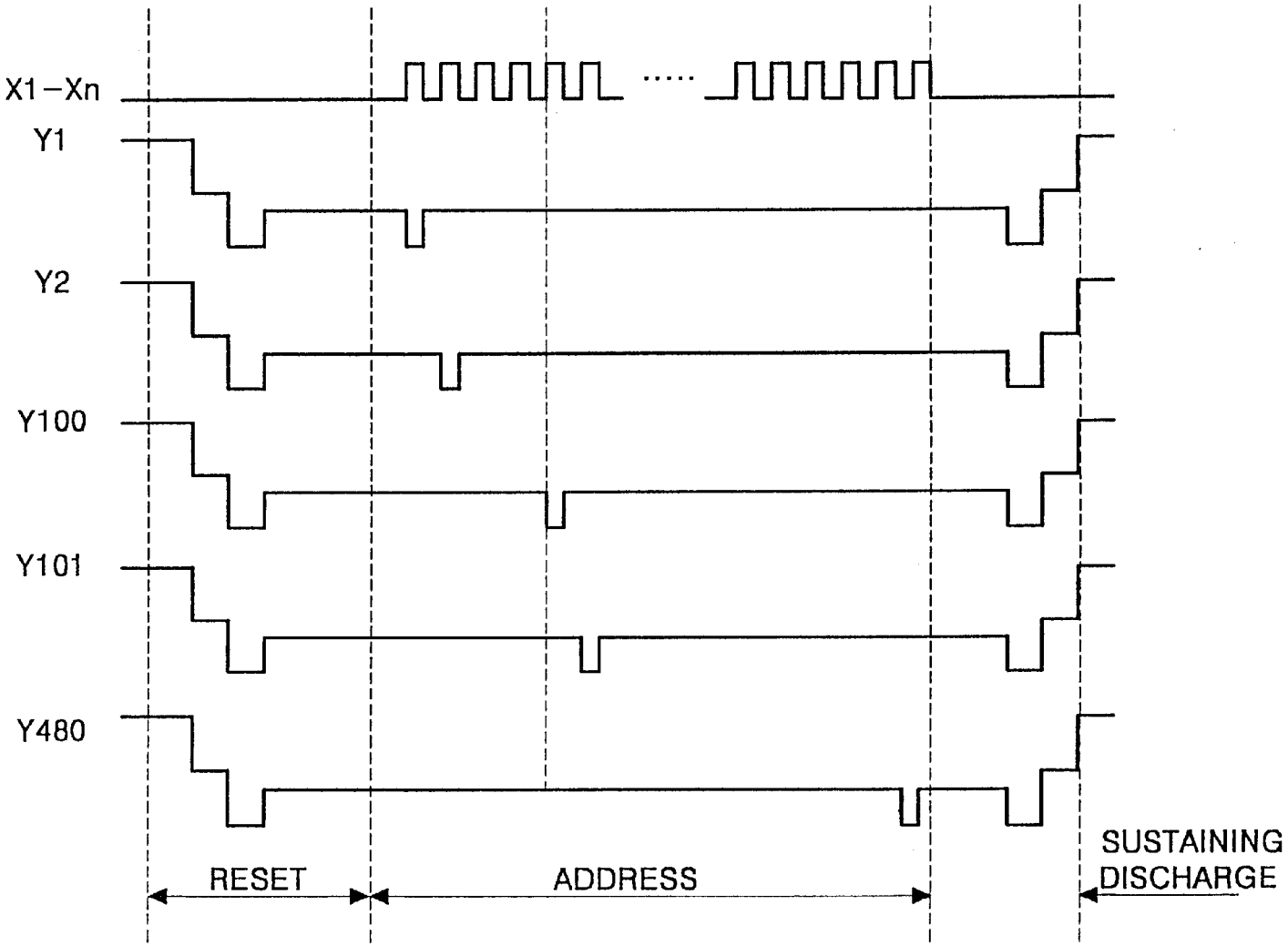
FIG. 8 is waveform diagrams of driving signals for making a reset discharge and an address discharge of the PDP in FIG. 7.

FIG. 8 shows waveform diagrams of driving signals for making a reset discharge and an address discharge of the PDP in FIG. 7. When the PDP in FIG. 7 has 480 scanning lines, all the 480 scanning lines are reset-discharged in a reset interval and then a data is sequentially written into the 480 scanning lines in an address interval. In the reset interval, a negative polarity(−) of reset pulse −Vrst is applied to the entire scanning/sustaining electrode lines Y1 to Y480 to cause a discharge between the address electrode lines X1 to Xn and the scanning/sustaining electrode lines Y1 to Y480. At this time, the scanning lines of the entire screen are charged with the same amount of wall charge to be initialized. The wall charge formed in the reset interval lowers a driving voltage during the address discharge. In the address interval, a negative polarity(−) of scanning pulse −Vscan synchronized with a video data is sequentially applied to the scanning/sustaining electrode lines Y1 to Y480. Accordingly, the video data is sequentially written into the first to 480th scanning/sustaining electrode lines Y1 to Y480.

Figure 9:
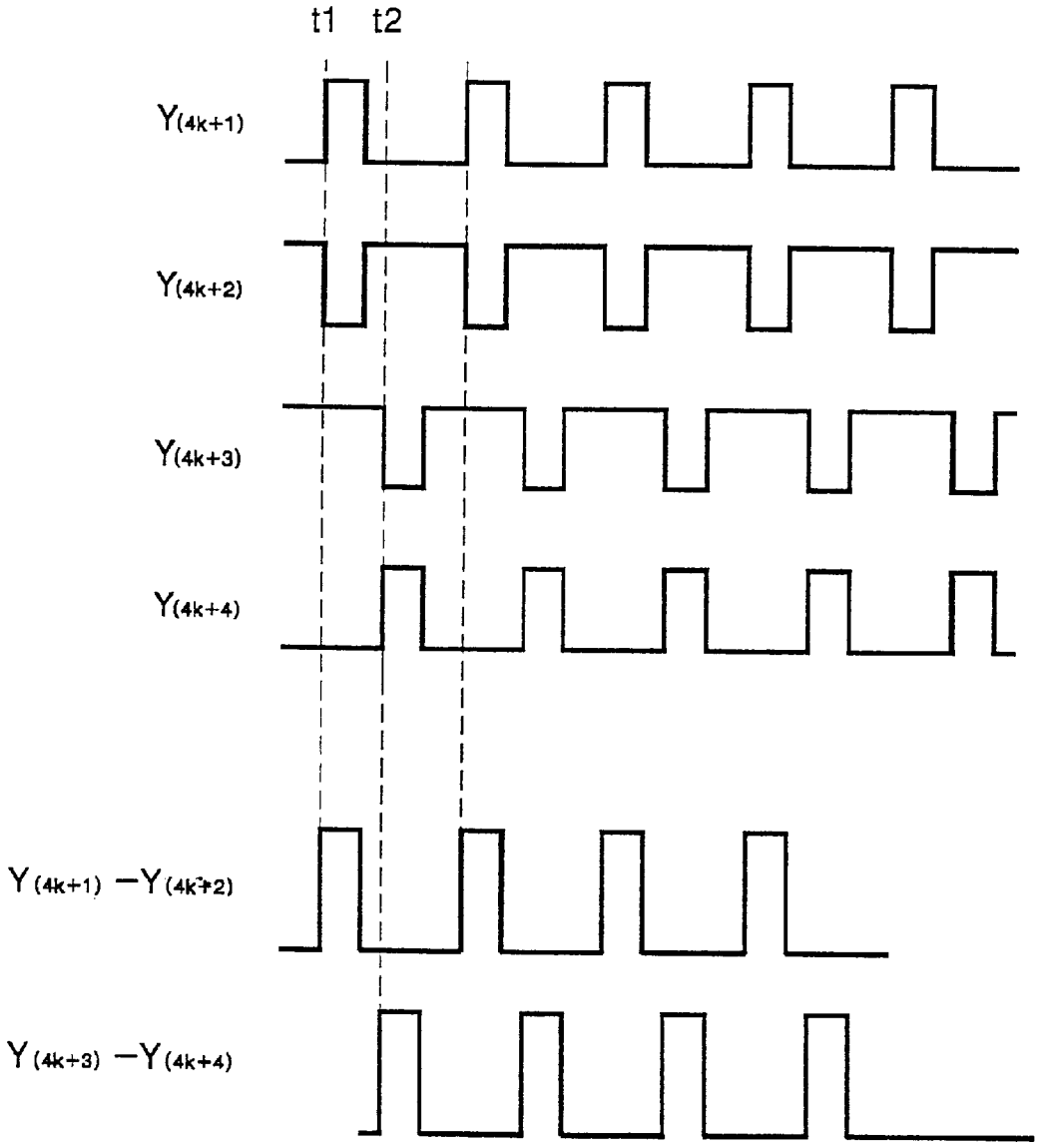
FIG. 9 is waveform diagrams of driving signals for making a sustaining discharge of the PDP in FIG. 7.
Figure 10:
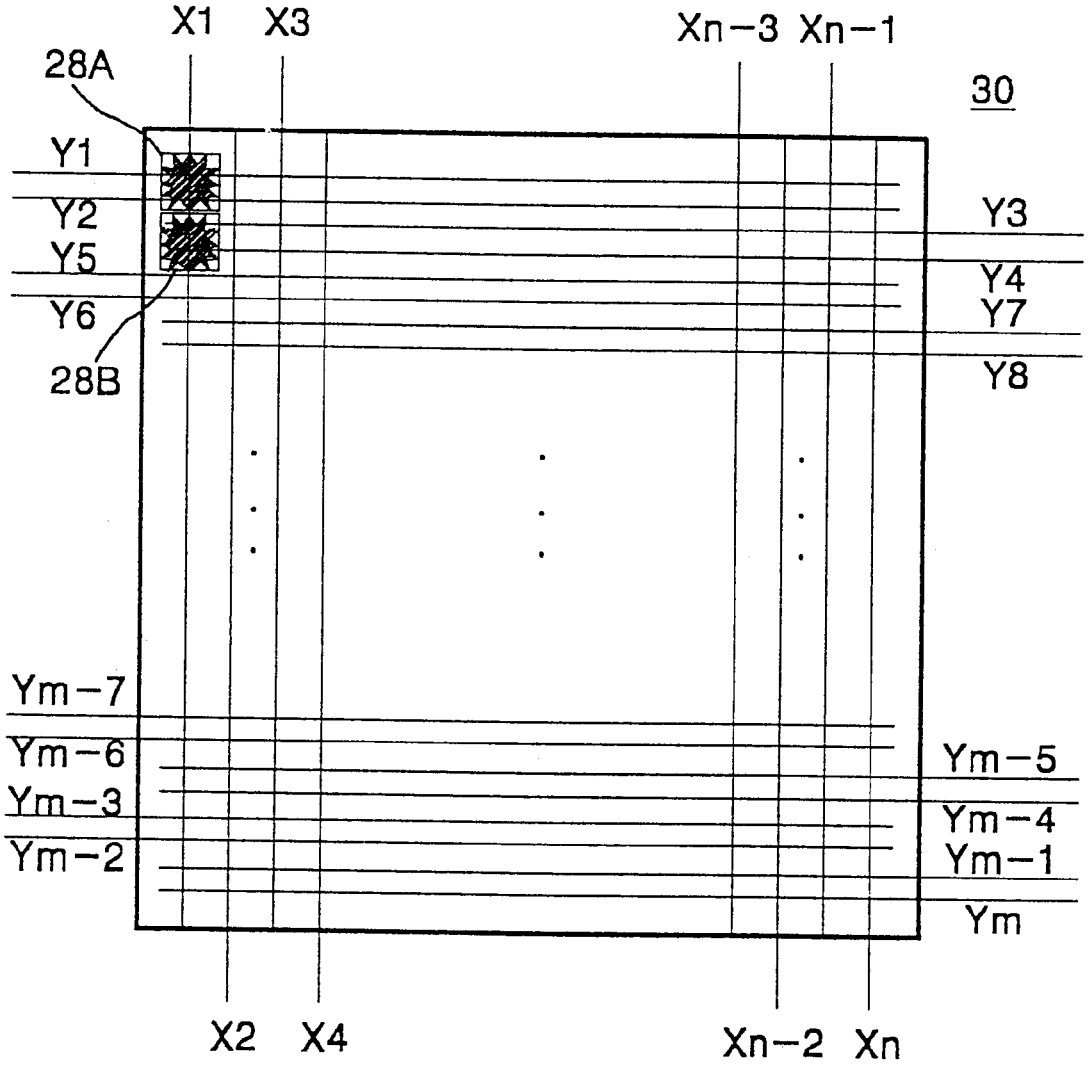
FIG. 10 is a plan view showing discharge areas upon sustaining discharge of the PDP in FIG. 7.

FIG. 9 shows waveforms of driving signals for making a sustaining discharge of the PDP in FIG. 7, and which will be explained in conjunction with FIG. 10 representing discharge areas. In an interval t1, an inverse phase of sustaining pulses with positive(+) and negative(−) high levels are applied to the (4k+1)th scanning/sustaining electrode lines Y(4k+1) and the (4k+2)th scanning/sustaining electrode lines Y(4k+2), respectively. On the other hand, an inverse phase of sustaining pulses applied to (4k+3)th scanning/sustaining electrode lines Y(4k+3) and (4k+4)th scanning/sustaining electrode lines Y(4k+4) have the same low level. Accordingly, a voltage difference Y(4k+1)−Y(4k+2) between the (4k+1)th scanning/sustaining electrode lines and the (4k+2)th scanning/sustaining electrode lines becomes more than a voltage level capable of causing a discharge, so that a sustaining discharge is generated between the (4k+1)th scanning/sustaining electrode lines Y(4k+1) and the (4k+2)th scanning/sustaining electrode lines Y(4k+2). Otherwise, a voltage difference between the (4k+3)th scanning/sustaining electrode lines Y(4k+3) and the (4k+4)th scanning/sustaining electrode lines Y(4k+4) becomes less than a voltage level capable of causing a discharge, so that a sustaining discharge is not generated between the (4k+3)th scanning/sustaining electrode lines Y(4k+3) and the (4k+4)the scanning/sustaining electrode lines Y(4k+4).

Subsequently, in an interval t2, an inverse phase of sustaining pulses with a low level are applied to the (4k+1)th scanning/sustaining electrode lines Y(4k+1) and the (4k+2) th scanning/sustaining electrode lines Y(4k+3). On the other hand, an inverse phase of sustaining pulse with positive(+) and negative(−) high levels are applied to the (4k+3)th scanning/sustaining electrode lines Y(4k+3) and the (4k+4) th scanning/sustaining electrode lines Y(4k+4), respectively. Accordingly, a voltage difference Y(4k+1)−Y(4k+2) between the (4k+1)th scanning/sustaining electrode lines Y(4k+1) and the (4k+2)th scanning/sustaining electrode lines Y(4k+2) becomes less than a voltage level capable of causing a discharge, so that a sustaining discharge is not generated between the (4k+1)th scanning/sustaining electrode lines Y(4k+1) and the (4k+2)th scanning/sustaining electrode lines Y(4k+2). Otherwise, a voltage difference Y(4k+3)−Y(4k+4) between the (4k+3)th scanning/sustaining electrode lines Y(4k+3) and the (4k+4)th scanning/sustaining electrode lines Y(4k+4) becomes more than a voltage level capable of causing a discharge, so that a sustaining discharge is generated between the (4k+3)th scanning/sustaining electrode lines Y(4k+3) and the (4k+4) th scanning/sustaining electrode lines Y(4k+4).

For instance, as shown in FIG. 10, a sustaining discharge occurs at the discharge area 28A corresponding to two scanning line widths between the first scanning/sustaining electrode line Y1 and the second scanning/sustaining electrode line Y2 in the t1 interval. Then, a sustaining discharge occurs at the discharge area 28B corresponding to two scanning line widths between the third scanning/sustaining electrode lines Y3 and the fourth scanning/sustaining electrode lines Y4. The discharge areas 28A and 28B at this time includes two scanning line widths, a luminous area is enlarged to that extent.

Figure 11:
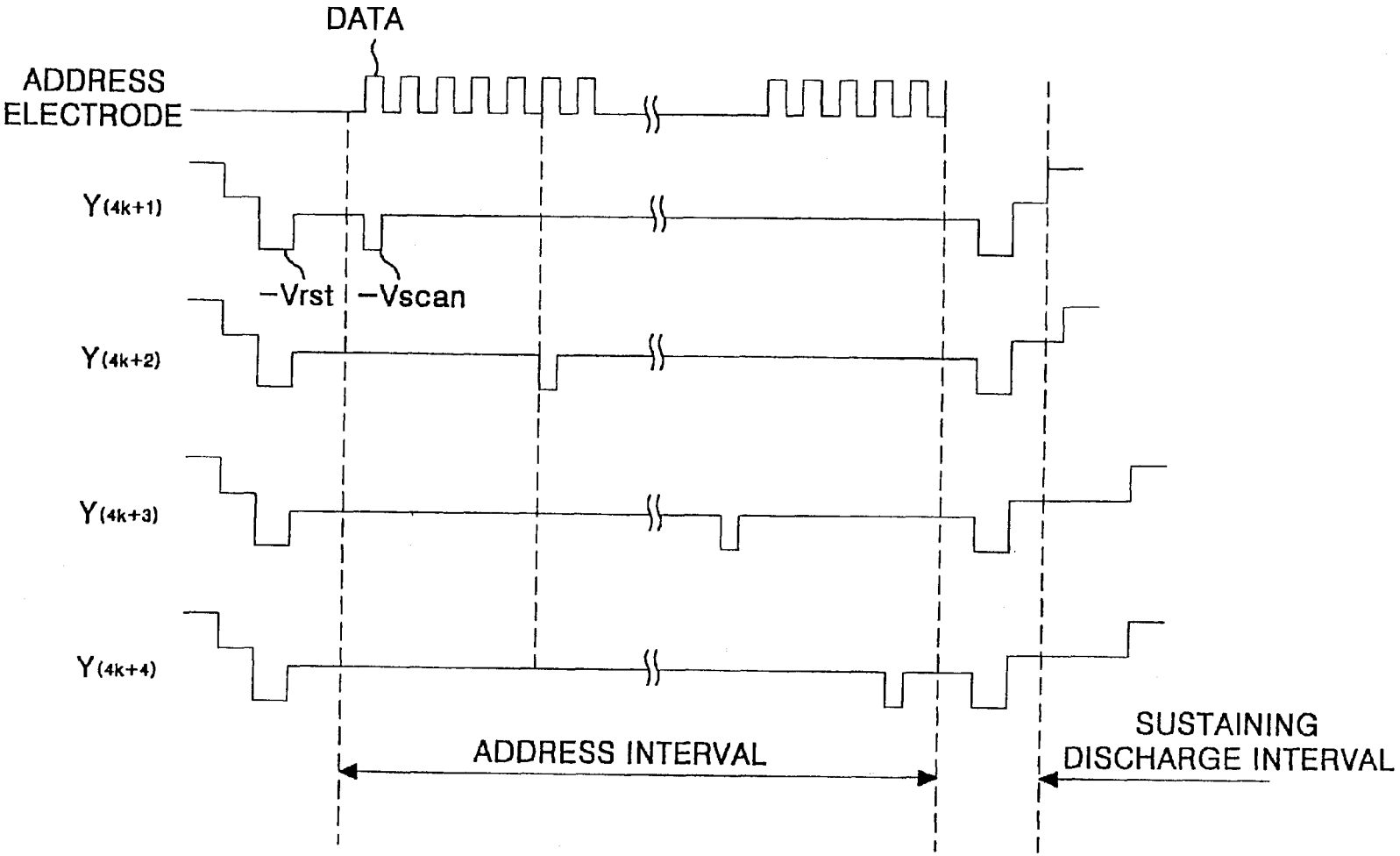
FIG. 11 is waveform diagrams of another driving signals for making a reset discharge and an address discharge of the PDP in FIG. 7.

FIG. 11 shows waveform diagrams of another driving signals for making a reset discharge and an address discharge of the PDP in FIG. 7. Referring to FIG. 11, in the reset interval, a negative polarity(−) of reset pulse −Vrst is applied to the entire scanning/sustaining electrode lines Y1 to Ym to cause a discharge between the address electrode lines X1 to Xn and the scanning/sustaining electrode lines Y1 to Y480. At this time, the scanning lines of the entire screen are charged with the same amount of wall charge to be initialized. In the address interval, a negative polarity(−) of scanning pulse −Vscan synchronized with a video data is sequentially applied to the (4k+1)th scanning/sustaining lines Y(4k+1), the (4k+2)th scanning/sustaining lines Y(4k+2), the (4k+3)th scanning/sustaining lines Y(4k+3) and the (4k+4)th scanning/sustaining lines Y(4k+4).

Figure 12:
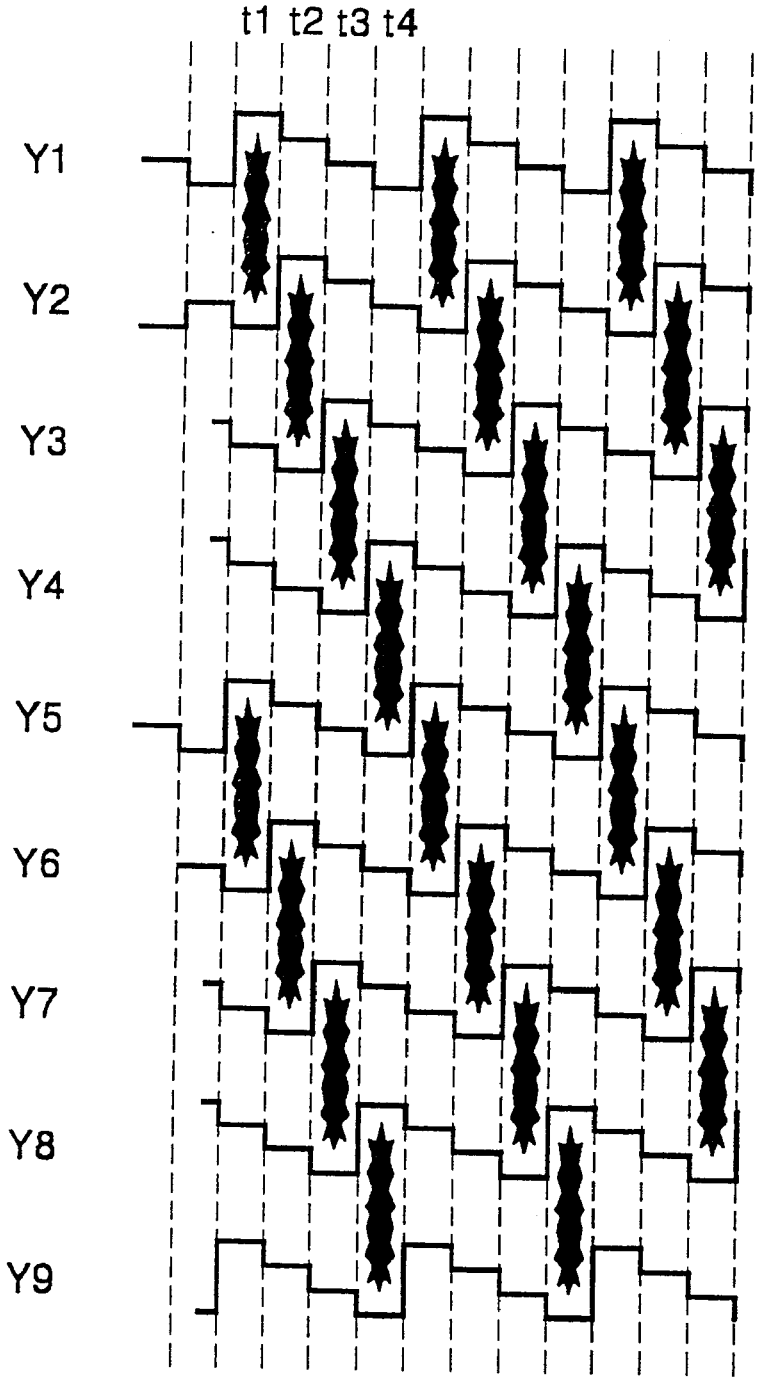
FIG. 12 is waveform diagrams of another driving signals for making a sustaining discharge of the PDP in FIG. 7.
Figure 13:
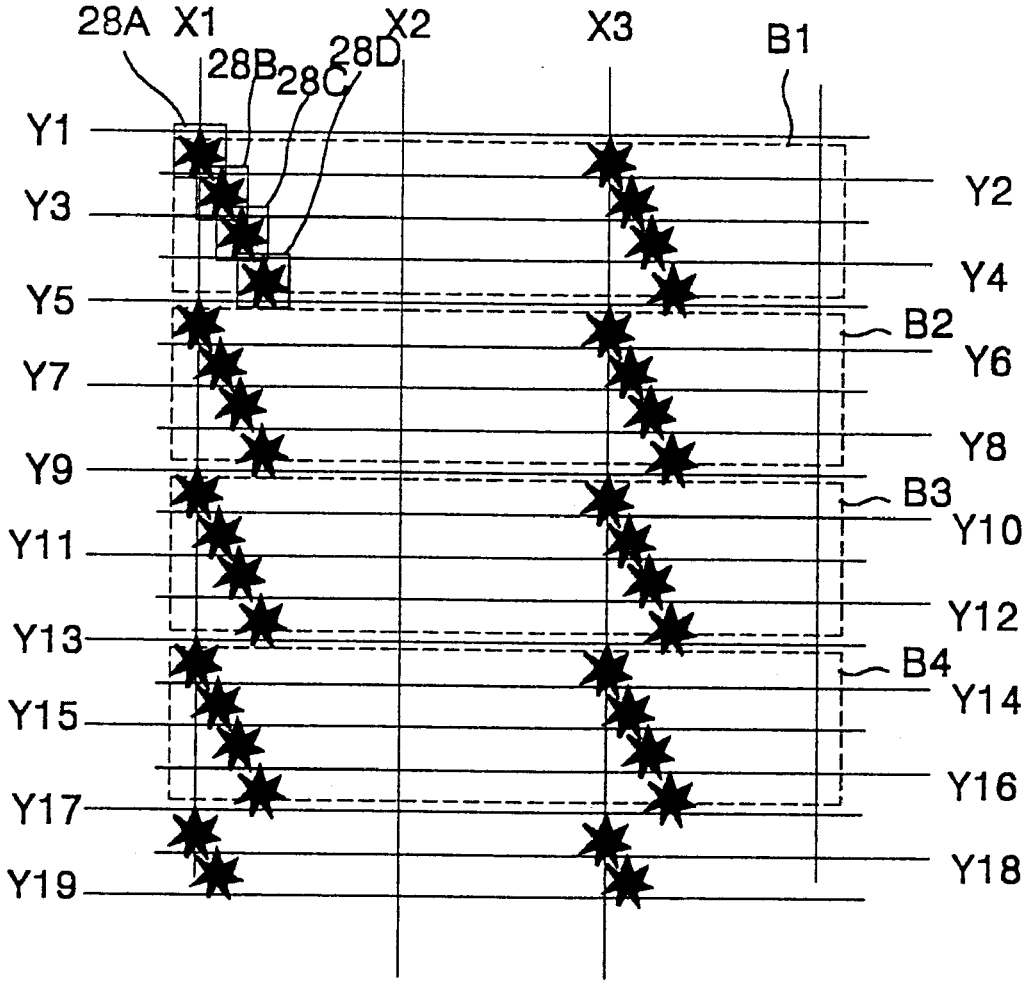
FIG. 13 is a plan view showing discharge areas and blocks upon sustaining discharge of the PDP in FIG. 7.

FIG. 12 is waveforms of another driving signals for making a sustaining discharge of the PDP in FIG. 7, which represent four-step sustaining pulses for causing a sustaining discharge at 9 scanning lines. FIG. 12 will be described in conjunction with FIG. 13 representing discharge areas. Referring to FIG. 12 and FIG. 13, in the sustaining interval, the four-step sustaining pulses applied to the (4k+1)th to (4k+4)th scanning/sustaining electrode lines Y(4k+1) to Y(4k+4) has the same shape in which their phases are delayed by one pulse width. These four-step sustaining pulses have the same shape every four scanning line interval. Accordingly, as shown in FIG. 13, the PDP in FIG. 7 is sequentially sustaining-discharged within blocks B1 to B4 each including four scanning lines, which are sustaining-discharged in the same sustaining discharge sequence. First, in an interval t1, a high level of sustaining pulses are applied to the first, fifth and ninth scanning/sustaining electrode lines Y1, Y5 and Y9. At this time, a low level of sustaining pulses are applied to the second and sixth scanning/sustaining electrode lines Y2 and Y6 while a first intermediate level of sustaining pulses higher than the low level are applied to the third and seventh scanning/sustaining electrode lines Y3 and Y7. A second intermediate level of sustaining pulses having a level value between the high level and the first intermediate level are applied to the fourth and eighth scanning/sustaining electrode lines Y4 and Y8. Accordingly, more than a voltage level capable of causing a discharge is derived between the first scanning/sustaining electrode line Y1 and the second scanning/sustaining electrode line Y2 and between the fifth scanning/sustaining electrode lines Y5 and the sixth scanning/sustaining electrode line Y6 in the t1 interval, so that a sustaining discharge is generated. Otherwise, since other scanning/sustaining electrode lines have a voltage difference less than a voltage level capable of causing a discharge, a sustaining discharge is not generated.

In the t2 interval, voltage levels of the first, fifth and ninth scanning/sustaining electrode lines Y1, Y5 and Y9 are changed into the second intermediate level. At this time, voltage levels of the second and sixth scanning/sustaining electrode lines Y2 and Y6 are changed into the high level while voltage levels of the third and seventh scanning/sustaining electrode lines Y3 and Y7 are changed into the low level. Voltage levels of the fourth and eighth scanning/sustaining electrode lines Y4 and Y8 are changed into the first intermediate level. Accordingly, more than a voltage level capable of causing a discharge is derived between the second scanning/sustaining electrode line Y2 and the third scanning/sustaining electrode line Y3 and between the sixth scanning/sustaining electrode line Y6 and the seventh scanning/sustaining electrode line Y7 in the t2 interval, so that a sustaining discharge is generated. Otherwise, since other scanning/sustaining electrode lines have a voltage difference less than a voltage level capable of causing a discharge, a sustaining discharge is not generated.

In the t3 interval, voltage levels of the first, fifth and ninth scanning/sustaining electrode lines Y1, Y5 and Y9 are changed into the first intermediate level. At this time, voltage levels of the second and sixth scanning/sustaining electrode lines Y2 and Y6 are changed into the second intermediate level while voltage levels of the third and seventh scanning/sustaining electrode lines Y3 and Y7 are changed into the high level. Voltage levels of the fourth and eighth scanning/sustaining electrode lines Y4 and Y8 are changed into the low level. Accordingly, more than a voltage level capable of causing a discharge is derived between the third scanning/sustaining electrode line Y3 and the fourth scanning/sustaining electrode line Y4 and between the seventh scanning/sustaining electrode line Y7 and the eight scanning/sustaining electrode line Y8 in the t3 interval, so that a sustaining discharge is generated.

Otherwise, since other scanning/sustaining electrode lines have a voltage difference less than a voltage level capable of causing a discharge, a sustaining discharge is not generated.

In the t4 interval, voltage levels of the first, fifth and ninth scanning/sustaining electrode lines YI, Y5 and Y9 are changed into the low level. At this time, voltage levels of the second and sixth scanning/sustaining electrode lines Y2 and Y6 are changed into the first intermediate level while voltage levels of the third and seventh scanning/sustaining electrode lines Y3 and Y7 are changed into the second intermediate level. Voltage levels of the fourth and eighth scanning/sustaining electrode lines Y4 and Y8 are changed into the high level. Accordingly, more than a voltage level capable of causing a discharge is derived between the fourth scanning/sustaining electrode line Y4 and the fifth scanning/sustaining electrode line Y5 and between the eighth scanning/sustaining electrode line Y8 and the ninth scanning/sustaining electrode line Y9 in the t4 interval, so that a sustaining discharge is generated. Otherwise, since other scanning/sustaining electrode lines have a voltage difference less than a voltage level capable of causing a discharge, a sustaining discharge is not generated. As a result, a sustaining discharge is sequentially generated at the scanning lines within a desired size of blocks B1 to B4, each of which is simultaneously sustaining-discharged. Each discharge area 28A to 28D at this time includes two scanning line widths, so that a luminous area is enlarged to that extent.

Figure 14:
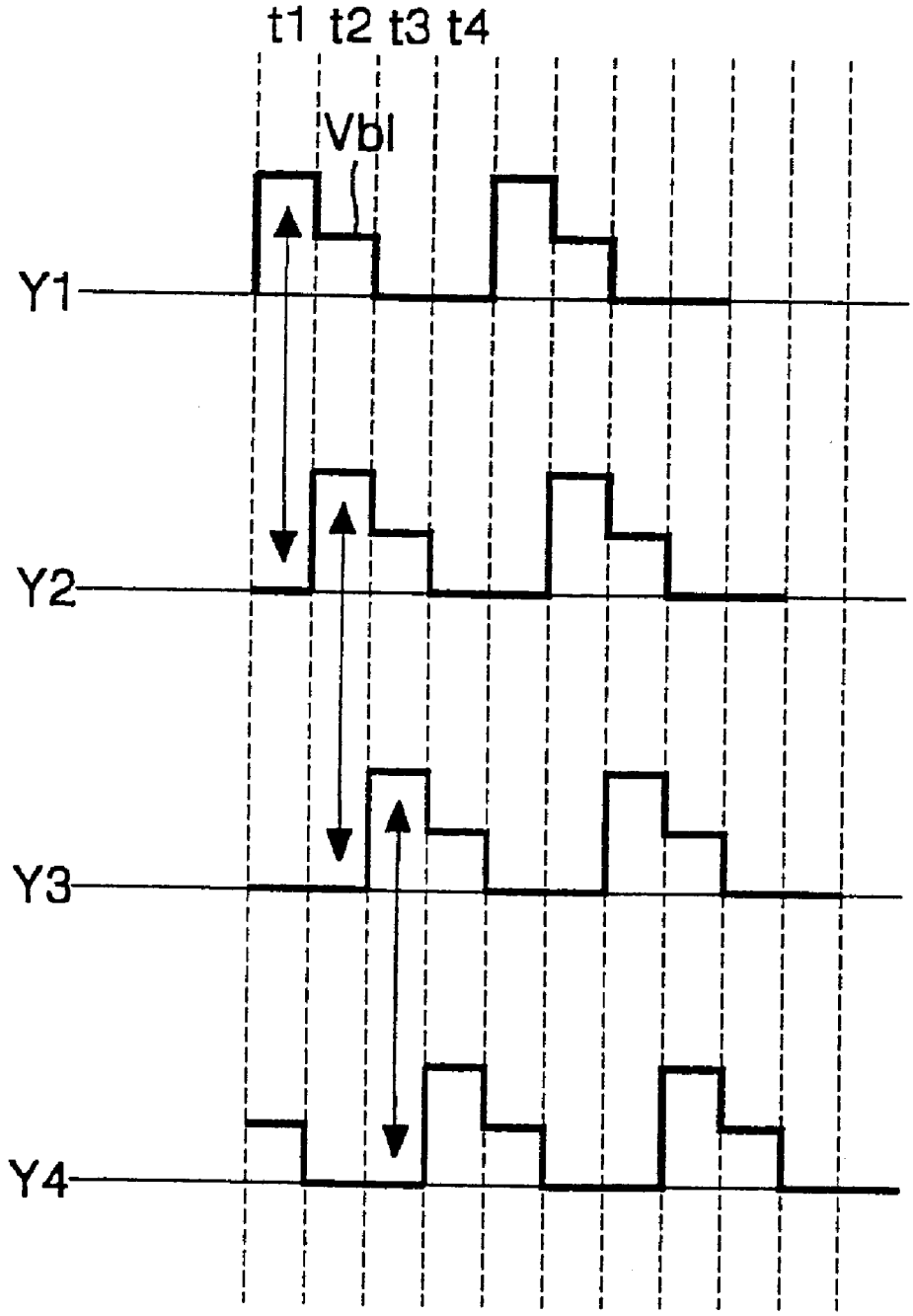
FIG. 14 is waveform diagrams of still another driving signals for making a sustaining discharge of the PDP in FIG. 7.

FIG. 14 is waveforms of still another driving signals for making a sustaining discharge of the PDP in FIG. 7, which represent three-step sustaining pulses for causing a sustaining discharge at 4 scanning lines. Referring to FIG. 14, in the sustaining interval, the three-step sustaining pulses applied to the (4k+1)th to (4k+4)th scanning/sustaining electrode lines Y(4k+1) to Y(4k+4) has the same shape in which their phases are delayed by one pulse width. These three-step sustaining pulses have the same shape every four scanning line interval. Also, the three-step sustaining pulse includes a block pulse Vbl. Accordingly, as shown in FIG. 13, the PDP in FIG. 7 is sequentially sustaining-discharged within blocks B1 to B4 each including four scanning lines, which are sustaining-discharged in the same sustaining discharge sequence. First, in an interval t1, a high level of sustaining pulse is applied to the first scanning/sustaining electrode line Y1. At this time, a low level of sustaining pulse is applied to the second scanning/sustaining electrode line Y2 while the block pulse Vbl is applied to the third scanning/sustaining electrode line Y3. A low level of sustaining pulse is applied to the fourth scanning/sustaining electrode line Y4. Accordingly, a sustaining discharge is generated only between the first scanning/sustaining electrode line Y1 and the second scanning/sustaining electrode line Y2 in the t1 interval.

In the t2 interval, a voltage level of the first scanning/sustaining electrode lines Y1 is changed into an intermediate level. At this time, a voltage level of the second scanning/sustaining electrode lines Y2 is changed into the high level while a voltage level of the third scanning/sustaining electrode lines Y3 is changed into the low level. The block pulse Vbl is applied to the fourth scanning/sustaining electrode line Y4. Accordingly, a sustaining discharge is generated only between the second scanning/sustaining electrode line Y2 and the third scanning/sustaining electrode line Y3 in the t2 interval.

In the t3 interval, a voltage level of the first scanning/sustaining electrode lines Y1 is changed into the low level. At this time, a voltage level of the second scanning/sustaining electrode lines Y2 is changed into the intermediate level while a voltage level of the third scanning/sustaining electrode lines Y3 is changed into the high level. A voltage level of the fourth scanning/sustaining electrode line Y4 is changed into the low level. Accordingly, a sustaining discharge is generated only between the third scanning/sustaining electrode line Y3 and the fourth scanning/sustaining electrode line Y4 in the t3 interval.

In the t4 interval, a voltage level of the first scanning/sustaining electrode lines Y1 remains at the low level. At this time, a voltage level of the second scanning/sustaining electrode lines Y2 is changed into the low level while a voltage level of the third scanning/sustaining electrode lines Y3 is changed into the intermediate level. A voltage level of the fourth scanning/sustaining electrode line Y4 is changed into the high level. Accordingly, a sustaining discharge is generated only between the fourth scanning/sustaining electrode line Y4 and the fifth scanning/sustaining electrode line Y5(not shown) in the t4 interval.

Figure 15:
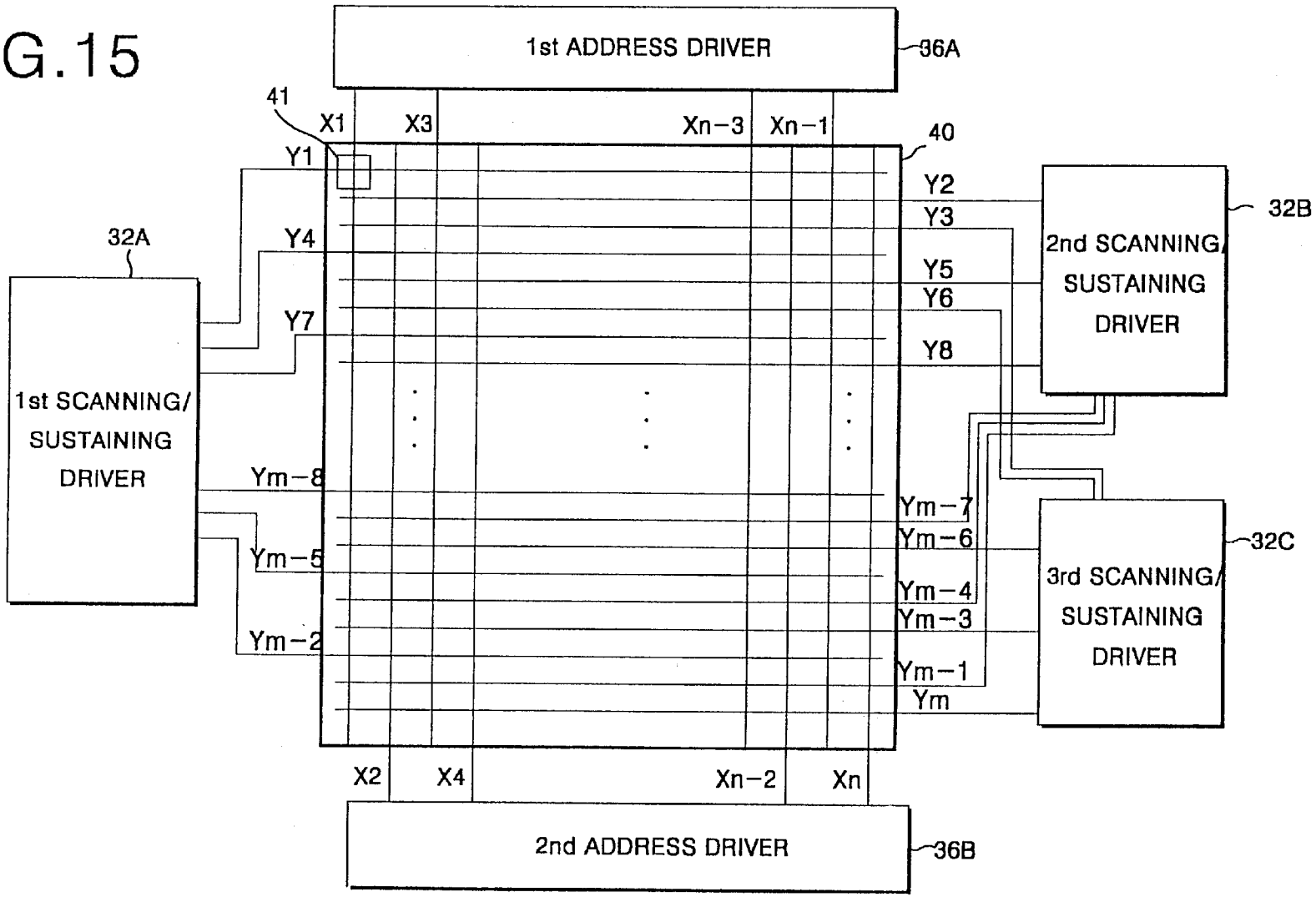
FIG. 15 is a schematic view showing the configuration of a PDP driving apparatus according to a third embodiment of the present invention.

Referring now to FIG. 15, there is shown a PDP driving apparatus according to a third embodiment of the present invention. The PDP driving apparatus includes a PDP 40 in which m scanning lines consists of m scanning/sustaining electrode lines Y1 to Ym and n address electrode lines X1 to Xn are crossed with the m scanning/sustaining electrode lines Y1 to Ym, a first scanning/sustaining driver 32A for driving (4k+1)th scanning/sustaining electrode lines Y(3k+1) (wherein k is an integer corresponding to $0 \leqq k < (m-3)/3$), i.e., Y1, Y4, . . . , Ym−5, Ym−2, a second scanning/sustaining driver 32B for driving (3k+2)th scanning/sustaining electrode lines Y(3k+2), i.e., Y2, Y5, . . . , Ym−4, Ym−1, a third scanning/sustaining driver 32C for driving (3k+3)th scanning/sustaining electrode lines Y(3k+3), i.e., Y3, Y6, . . . , Ym−3, Ym. Each of the m×n discharge cells 41 is arranged in a matrix pattern at intersections between the scanning/sustaining electrode lines Y1 to Ym and the address electrode lines X1 to Xn. A barrier rib(not shown) is formed in parallel to the address electrode lines X1 to Xn. The first scanning/sustaining driver 32A applies the scanning pulse synchronized with a video data to (3k+1)th scanning/sustaining electrode lines Y(3k+1) during an address interval to cause an address discharge between the (3k+3)th scanning/sustaining electrode lines Y(3k+1) and the address electrode lines X1 to Xn. The first scanning/sustaining driver 32A applies a three-step sustaining pulse to (3k+1)th scanning/sustaining electrode lines Y(3k+1) during a sustaining interval. The second scanning/sustaining driver 32B applies the scanning pulse synchronized with a video data to (3k+2)th scanning/sustaining electrode lines Y(3k+2) during an address interval to cause an address discharge between the (3k+2)th scanning/sustaining electrode lines Y(3k+2) and the address electrode lines X1 to Xn. The second scanning/sustaining driver 32B applies a three-step sustaining pulse phase-delayed to the three-step sustaining applied to the (3k+1)th scanning/sustaining electrode lines Y(3k+1) to (3k+2)th scanning/sustaining electrode lines Y(3k+2) during a sustaining interval. The third scanning/sustaining driver 32C applies the scanning pulse synchronized with a video data to (3k+3)th scanning/sustaining electrode lines Y(3k+3) during an address interval to cause an address discharge between the (3k+3)th scanning/sustaining electrode lines Y(3k+3) and the address electrode lines X1 to Xn. The third scanning/sustaining driver 32C applies a three-step sustaining pulse phase-delayed to the three-step sustaining applied to the (3k+2)th scanning/sustaining electrode lines Y(3k+2) to (3k+3)th scanning/sustaining electrode lines Y(3k+3) during a sustaining interval.

Further, the PDP driving apparatus according to the third embodiment of the present invention includes a first address driver 36A for supplying a video data to the odd-numbered address electrode lines Xodd, and a second address driver 36B for supplying a video data to the even-numbered address electrode lines Xeven. The first address driver 36A is synchronized with scanning pulses applied to the scanning lines to supply a video data to the odd-numbered address lines Xodd. The second address driver 36B is synchronized with scanning pulses applied to the scanning lines to supply a video data to the even-numbered address lines Xeven.

Figure 16:
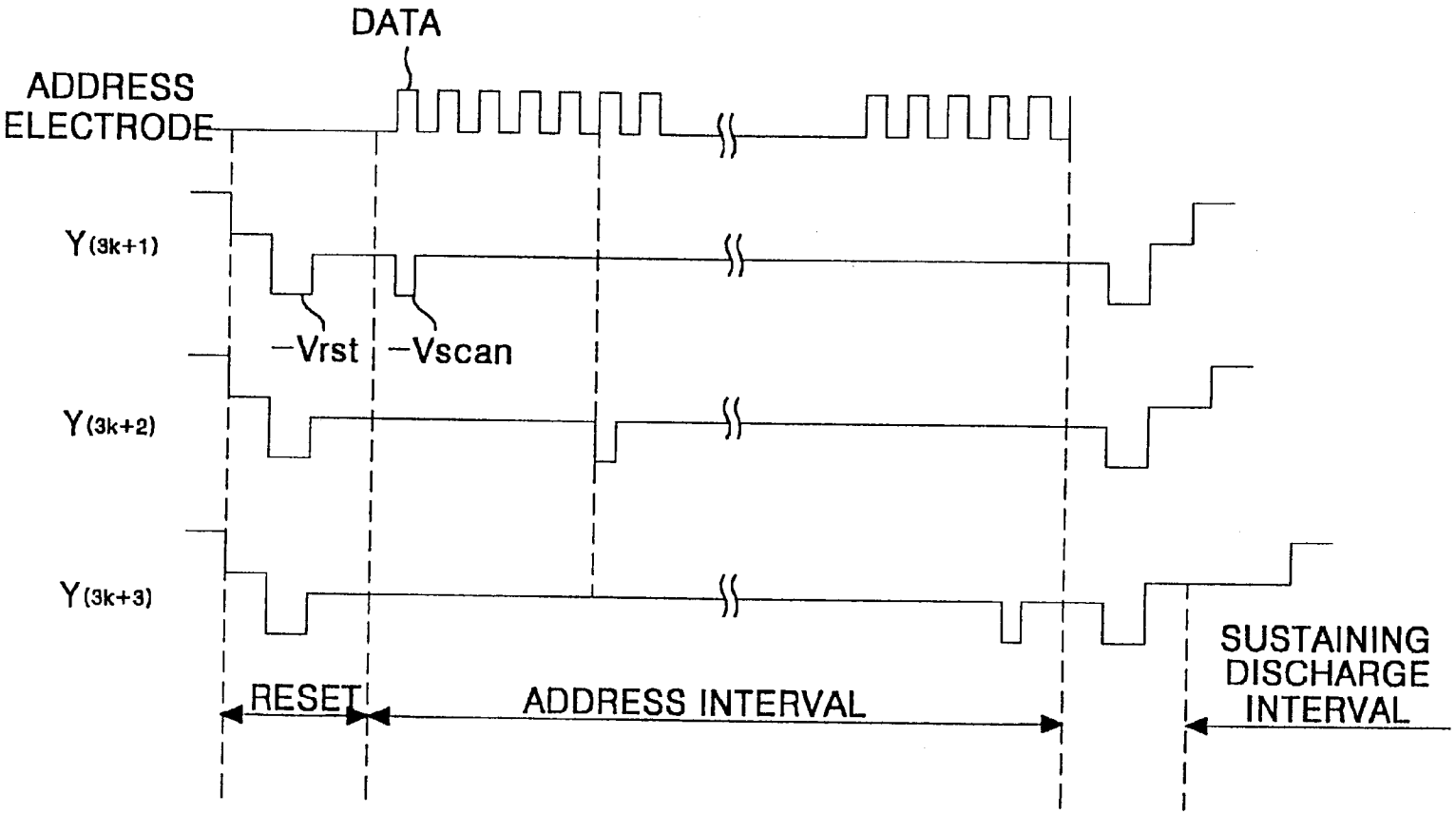
FIG. 16 is waveform diagrams of driving signals for making a reset discharge and an address discharge of the PDP in FIG. 15.

FIG. 16 shows waveform diagrams of driving signals for making a reset discharge and an address discharge of the PDP in FIG. 15. Referring to FIG. 16, in the reset interval, a negative polarity(−) of reset pulse −Vrst is applied to the entire scanning/sustaining electrode lines Y1 to Ym to cause a discharge between the address electrode lines X1 to Xn and the scanning/sustaining electrode lines Y1 to Ym. At this time, the scanning lines of the entire screen are charged with the same amount of wall charge to be initialized. In the address interval, a negative polarity(−) of scanning pulse −Vscan synchronized with a video data is sequentially applied to the (3k+1)th scanning/sustaining lines Y(3k+1), the (3k+2)th scanning/sustaining lines Y(3k+2) and the (3k+3)th scanning/sustaining lines Y(3k+3).

Figure 17:
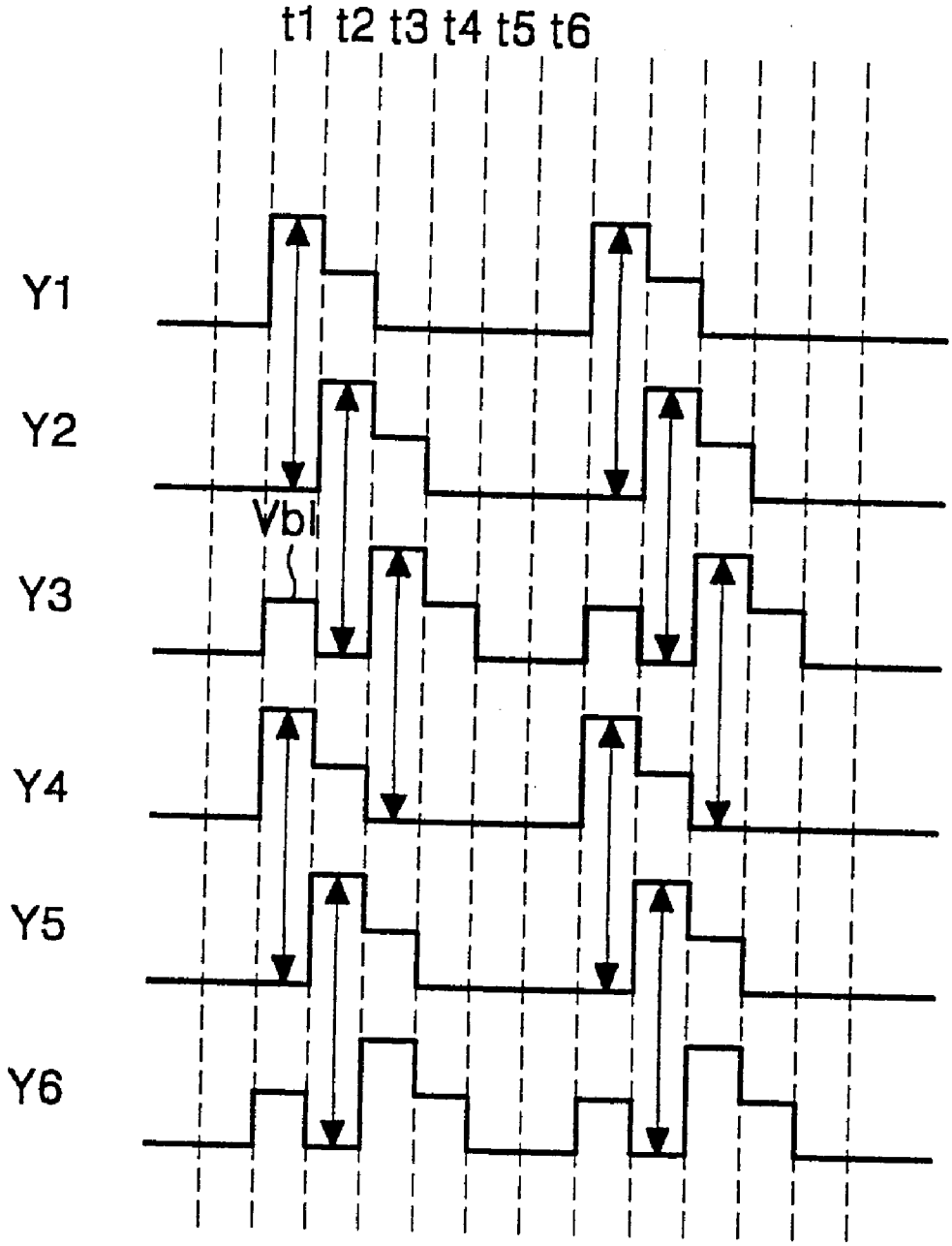
FIG. 17 is waveform diagrams of driving signals for making a sustaining discharge of the PDP in FIG. 15.
Figure 18:
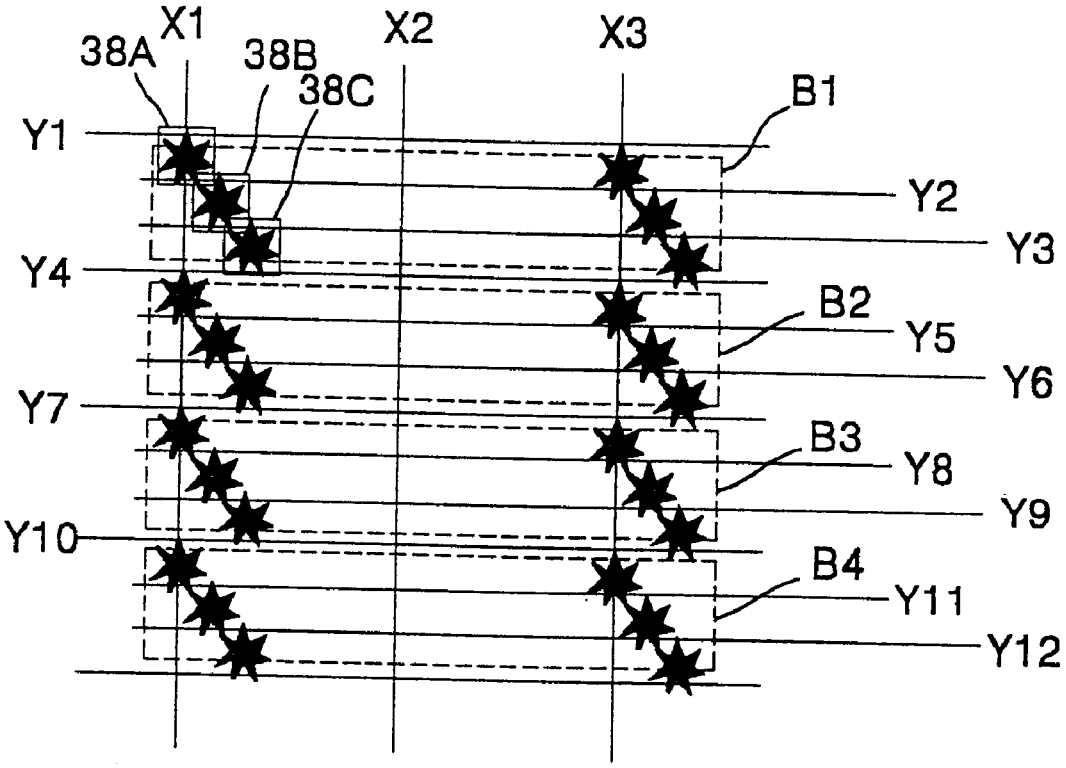
FIG. 18 is a plan view showing discharge areas upon sustaining discharge of the PDP in FIG. 15.

FIG. 17 shows waveforms of driving signals for making a sustaining discharge of the PDP shown in FIG. 15, which represent three-step sustaining pulses for causing a sustaining discharge at 6 scanning lines. FIG. 17 will be described in conjunction with FIG. 18 representing discharge areas. Referring to FIG. 17 and FIG. 18, three-step sustaining pulses applied to the (3k+1)th and (3k+2)th scanning/sustaining electrode lines Y(3k+1) and Y(3k+2) are supplied with waveforms in which their phase are different and their shape are same. Otherwise, a three-step sustaining pulse applied to the (3k+3)th scanning/sustaining electrode lines Y(3k+3) has a phase difference with respect to the three-step sustaining pulse applied to the (3k+1)th and (3k+2)th scanning/sustaining electrode lines. In addition, it includes a block pulse Vbl. This block pulse Vbl prevents an interference between the adjacent scanning lines and a misdischarge at the time of sustaining discharge. First, in an interval t1, a high level of sustaining pulses are applied to the first and fourth scanning/sustaining electrode lines Y1 and Y4 included in the (3k+1)th scanning/sustaining electrode lines Y(3k+1). At this time, a low level of sustaining pulses are applied to the second and fifth scanning/sustaining electrode lines Y2 and Y5 included in the (3k+2)th scanning/sustaining electrode lines Y(3k+2) while an intermediate level of block pulse Vbl is applied to the third and sixth scanning/sustaining electrode lines Y3 and Y6 included in the (3k+3)th scanning/sustaining electrode lines Y(3k+3). Accordingly, in the t1 interval, the first and second scanning/sustaining electrode lines Y1 and Y2 has a voltage difference more than a voltage level capable of causing a discharge, so that a sustaining discharge is generated. Likewise, a sustaining discharge is generated between the fourth and fifth scanning electrode lines Y4 and Y5. Otherwise, a voltage difference less than a voltage level capable of causing a discharge is derived between the second and third scanning/sustaining electrode lines Y2 and Y3 and between the third and fourth scanning/sustaining electrode lines Y3 and Y4, so that a sustaining discharge is not generated.

In the t2 interval, sustaining pulses with an intermediate level equal to a level of the block pulse Vbl are applied to the first and fourth scanning/sustaining electrode lines Y1 and Y4. At this time, a high level of sustaining pulses are applied to the second and fifth scanning/sustaining electrode lines Y2 and Y5 while a low level of sustaining pulses are applied to the third and sixth scanning/sustaining electrode lines Y3 and Y6. Accordingly, in the t2 interval, the second and third scanning/sustaining electrode lines Y2 and Y3 has a voltage difference more than a voltage level capable of causing a discharge, so that a sustaining discharge is generated. Likewise, a sustaining discharge is generated between the fifth and sixth scanning electrode lines Y5 and Y6. Otherwise, a voltage difference less than a voltage level capable of causing a discharge is derived between the first and second scanning/sustaining electrode lines Y1 and Y2 and between the fourth and fifth scanning/sustaining electrode lines Y4 and Y5, so that a sustaining discharge is not generated.

In the t3 interval, a low level of sustaining pulses are applied to the first and fourth scanning/sustaining electrode lines Y1 and Y4. At this time, an intermediate level of sustaining pulses are applied to the second and fifth scanning/sustaining electrode lines Y2 and Y5 while a high level of sustaining pulses are applied to the third and sixth scanning/sustaining electrode lines Y3 and Y6. Accordingly, in the t3 interval, the third and fourth scanning/sustaining electrode lines Y3 and Y4 has a voltage difference more than a voltage level capable of causing a discharge, so that a sustaining discharge is generated. Otherwise, a voltage difference less than a voltage level capable of causing a discharge is derived between the first and second scanning/sustaining electrode lines Y1 and Y2, the second and third scanning/sustaining electrode lines Y2 and Y3, between the fourth and fifth scanning/sustaining electrode lines Y4 and Y5 and between the fifth and sixth scanning/sustaining electrode lines Y5 and Y6, so that a sustaining discharge is not generated.

In the t4 interval, an intermediate level of sustaining pulses are applied to the (3k+3)th scanning/sustaining electrode lines Y(3k+3), whereas a low level of sustaining pulses are applied to other scanning/sustaining electrode lines Y(3k+1) and Y(3k+2). In the t5 and t6 intervals, sustaining pulses applied to all the scanning/sustaining electrode lines Y1 to Ym remain at the low level. Accordingly, in the t5 and t6 intervals, a sustaining discharge is not generated at the entire scanning lines. The sustaining pulses applied in the t1 to t6 intervals are repeated in a sustaining interval after the t1 interval is terminated.

As a result, as shown in FIG. 18, a sustaining discharge is sequentially generated at the scanning lines within a desired size of blocks B1 to B4, each of which is simultaneously sustaining-discharged. Each discharge area 28A to 28D at this time includes two scanning line widths, so that a luminous area is enlarged to that extent.

Figure 19:
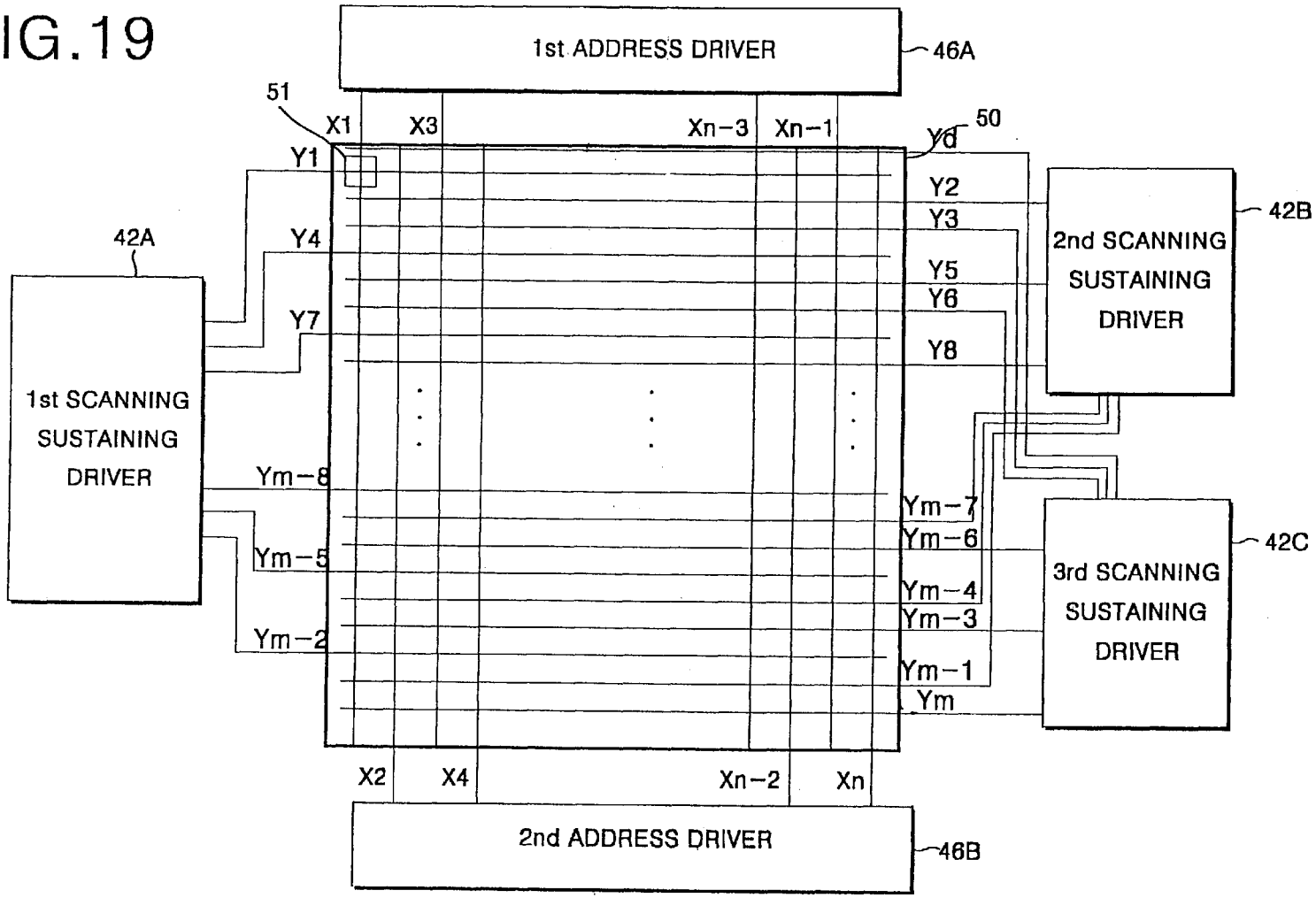
FIG. 19 is a schematic view showing the configuration of a PDP driving apparatus according to a fourth embodiment of the present invention.

Referring now to FIG. 19, there is shown a PDP driving apparatus according to a fourth embodiment of the present invention. The PDP driving apparatus includes a PDP 50 in which m scanning lines consists of m scanning/sustaining electrode lines Y1 to Ym and a dummy electrode line Yd is defined, a first scanning/sustaining driver 42A for driving (3k+1)th scanning/sustaining electrode lines Y(3k+1) (wherein k is an integer corresponding to $0 \leqq k < (m-3)/3$), a second scanning/sustaining driver 42B for driving (3k+2)th scanning/sustaining electrode lines Y(3k+2), a third scanning/sustaining driver 42C for driving (3k+3)th scanning/sustaining electrode lines Y(3k+3). Each of the m×n discharge cells 51 is arranged in a matrix pattern at intersections between the scanning/sustaining electrode lines Y1 to Ym and the address electrode lines X1 to Xn. The dummy electrode line Yd is formed on the upper portion of the first scanning/sustaining electrode line Y1 to generate a sustaining discharge along with the first scanning/sustaining electrode line Y1 by a voltage difference from the first scanning/sustaining electrode line Y1.

The first scanning/sustaining driver 42A causes an address discharge and, at the same time, applies three-step sustaining pulses to the (3k+1)th scanning/sustaining electrode lines Y(3k+1) in the sustaining interval to cause a sustaining discharge between the (3k+1)th scanning/sustaining electrode lines Y(3k+1) and the (3k+2)th scanning/sustaining electrode lines Y(3k+2). In this case, the (3k) th scanning/sustaining electrode lines Y(3k) includes the dummy electrode line Yd and the (3k+3) th scanning/sustaining electrode lines Y(3k+3). The second scanning/sustaining driver 42B causes an address discharge and, at the same time, applies three-step sustaining pulses to the (3k+2)th scanning/sustaining electrode lines Y(3k+2) in the sustaining interval to cause a sustaining discharge between the (3k+2)th scanning/sustaining electrode lines Y(3k+2) and the (3k+1) th scanning/sustaining electrode lines Y(3k+1). The third scanning/sustaining driver 42C causes an address discharge and, at the same time, applies three-step sustaining pulses to the (3k+3)th scanning/sustaining electrode lines Y(3k+3) in the sustaining interval to cause a sustaining discharge between the (3k+3)th scanning/sustaining electrode lines Y(3k+3) and the (3k+2)th scanning/sustaining electrode lines Y(3k+2). Meanwhile, the first and second address drivers 46A and 46B are synchronized with scanning pulses applied to the scanning lines to apply a video data to the address electrode lines X1 to Xn in similarity to those shown in FIG. 11.

Since a reset discharge and an address discharge of the PDP shown in FIG. 19 is caused by the driving waveform shown in FIG. 16, a detailed explanation as to that will be omitted. In the reset interval, the entire scanning lines are simultaneously discharged to be initialized. Subsequently, in the addressing interval, an address discharge is generated in a sequence of the scanning lines including the (3k+1)th scanning/sustaining electrode lines Y(3k+1), the scanning lines including the (3k+2)th scanning/sustaining electrode lines Y(3k+2) and the scanning lines including the (3k+3)th scanning/sustaining electrode lines Y(3k+3) by a scanning pulse −Vscan synchronized with a video data.

Figure 20:
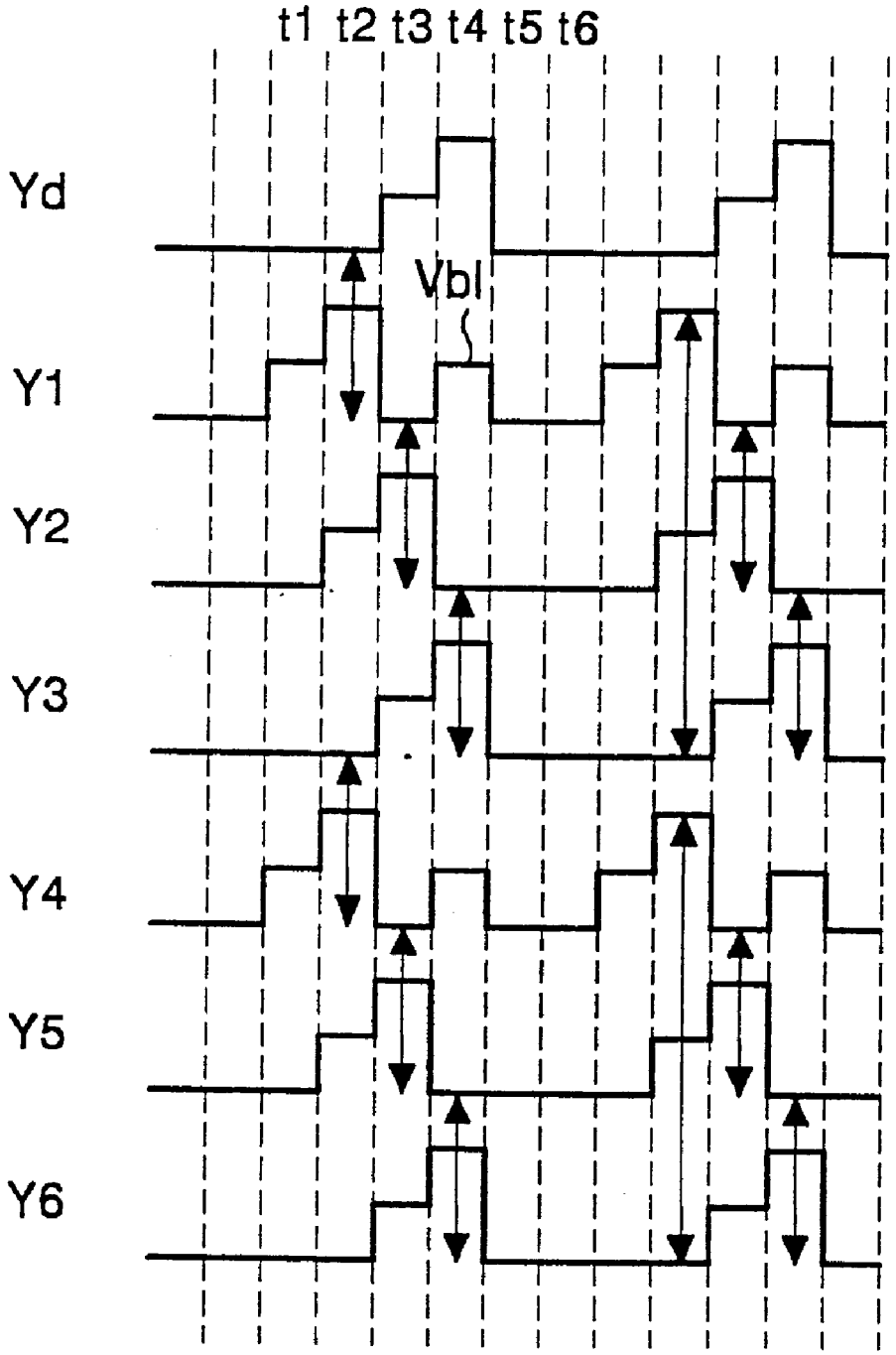
FIG. 20 is waveform diagrams of driving signals for making a sustaining discharge of the PDP in FIG. 19.
Figure 21:
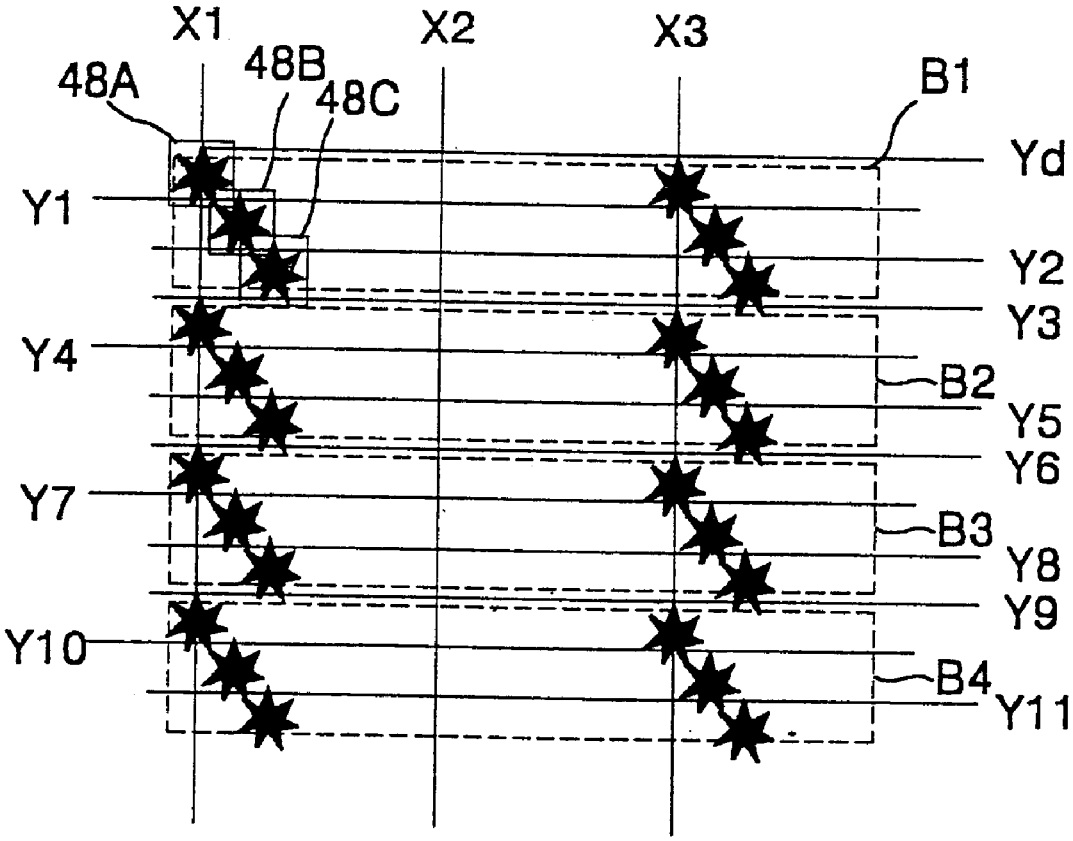
FIG. 21 is a plan view showing discharge areas upon sustaining discharge of the PDP in FIG. 19.

FIG. 20 shows waveforms of driving signals for making a sustaining discharge of the PDP shown in FIG. 19, which represent three-step sustaining pulses for causing a sustaining discharge at 6 scanning lines. FIG. 20 will be described in conjunction with FIG. 21 representing discharge areas. Referring to FIG. 20 and FIG. 21, three-step sustaining pulses applied to the (3k+2)th and (3k+3)th scanning/sustaining electrode lines Y(3k+2) and Y(3k+3) are supplied with waveforms in which their phase are different and their shape are same. Otherwise, three-step sustaining pulses applied to the (3k+1)th scanning/sustaining electrode lines Y(3k+1) have a phase difference with respect to the three-step sustaining pulses applied to the (3k)th and (3k+2)th scanning/sustaining electrode lines Y(3k) and Y(3k+2). In addition, they include a block pulse Vbl. This block pulse Vbl prevents an interference between the adjacent scanning lines and a misdischarge at the time of sustaining discharge. First, in an interval t1, an intermediate level of sustaining pulses are applied to the first and fourth scanning/sustaining electrode lines Y1 and Y4. At this time, a low level of sustaining pulses are applied to the second and fifth scanning/sustaining electrode lines Y2 and Y5, the dummy electrode line Yd and the third and sixth scanning/sustaining electrode lines Y3 and Y6. Accordingly, in the t1 interval, the first to sixth scanning/sustaining electrode lines Y1 to Y6 have a voltage difference less than a voltage level capable of causing a discharge, so that a sustaining discharge is not generated.

In the t2 interval, a high level of sustaining pulses are applied to the first and fourth scanning/sustaining electrode lines Y1 and Y4. At this time, voltage levels at the dummy electrode line Yd and the third and sixth scanning/sustaining electrode lines Y3 and Y6 remain at the low level, whereas voltage levels at the second and fifth scanning/sustaining electrode lines Y2 and Y5 are changed into the intermediate level. Accordingly, in the t2 interval, a voltage difference more than a voltage level capable of causing a discharge is derived between the dummy electrode line Yd and the first scanning/sustaining electrode line Y1, so that a sustaining discharge is generated. Otherwise, since other scanning/sustaining electrode lines have a voltage difference less than a voltage level capable of causing a discharge.

In the t3 interval, voltage levels of the first and fourth scanning/sustaining electrode lines Y1 and Y4 are changed into the low level. At this time, voltage levels at the dummy electrode line Yd and the third and sixth scanning/sustaining electrode lines Y3 and Y6 are changed into the intermediate level, whereas voltage levels at the second and fifth scanning/sustaining electrode lines Y2 and Y5 are changed into the high level. Accordingly, in the t3 interval, the first scanning/sustaining electrode line Y1 and the second scanning/sustaining electrode line Y2 have a voltage difference more than a voltage level capable of causing a discharge, so that a sustaining discharge is generated. Likewise, a sustaining discharge are generated between the fourth and fifth scanning/sustaining electrode lines Y4 and Y5. Otherwise, since other scanning/sustaining electrode lines have a voltage difference less than a voltage level capable of causing a discharge.

In the t4 interval, the block pulse Vbl is applied to the first and fourth scanning/sustaining electrode lines Y1 and Y4. At this time, voltage levels at the dummy electrode line Yd and the third and sixth scanning/sustaining electrode lines Y3 and Y6 are changed into the high level, whereas voltage levels at the second and fifth scanning/sustaining electrode lines Y2 and Y5 are changed into the low level. Accordingly, in the t4 interval, a sustaining discharge is generated between the second scanning/sustaining electrode line Y2 and the third scanning/sustaining electrode line Y3 and between the fifth scanning/sustaining electrode line Y5 and the sixth scanning/sustaining electrode line Y6. Otherwise, other scanning/sustaining electrode lines does not generate a sustaining discharge. In the t5 and t6 intervals, the first to sixth scanning/sustaining electrode lines Y1 to Y6 including the dummy electrode line Yd remains at the low level. Accordingly, in the t5 and t6 intervals, a sustaining discharge is not generated at the entire scanning lines. As a result, as shown in FIG. 21, a sustaining discharge is sequentially generated at the scanning lines within a desired size of blocks B1 to B4, each of which is simultaneously sustaining-discharged. Each discharge area 28A to 28D at this time includes two scanning line widths, so that a luminous area is enlarged to that extent.

As described above, the PDP and the driving apparatus and method thereof according to the present invention cause a sustaining discharge between the scanning/sustaining electrode lines formed at each of the adjacent scanning lines to increase a size of the discharge area, so that they can utilize the positive column area. Accordingly, a brightness and a discharge efficiency are improved. The PDP and the driving apparatus and method thereof according to the present invention are applicable to the interlace system as well as the progressive system suitable for a high definition television. Moreover, the PDP and the driving apparatus and method according to the present invention reduce the number of sustaining electrodes into 1/2, so that they are not only favorable to an implementation of high resolution, but also they can reduce the manufacturing cost thereof.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus for a plasma display panel, comprising:

a display panel arranged in such a manner that scanning/sustaining electrodes formed at each of adjacent scanning lines is adjacent to each other and in such a manner that common sustaining electrodes formed at each of the adjacent scanning lines is adjacent to each other; and driving means for generating a sustaining discharge between the scanning/sustaining electrode and the common sustaining electrode formed at each of the adjacent scanning lines, wherein said driving means comprises:

a first scanning/sustaining driver for driving each of odd-numbered scanning/sustaining electrodes;

a second scanning/sustaining driver for driving each of even-numbered scanning/sustaining electrodes;

a first common sustaining driver for commonly driving odd-numbered common sustaining electrodes; and a second common sustaining driver for commonly driving even-numbered common sustaining electrodes.

2. The driving apparatus as claimed in claim 1, wherein said driving means applies an inverse phase of sustaining pulses to the odd-numbered scanning/sustaining electrodes and the odd-numbered common sustaining electrodes; and to the even-numbered scanning/sustaining electrodes and the even-numbered common sustaining electrodes.

3. The driving apparatus as claimed in claim 1, wherein said driving means applies sustaining pulses having a phase difference corresponding to a pulse width to the odd-numbered scanning/sustaining electrodes and the even-numbered common sustaining electrodes; and to the even-numbered scanning/sustaining electrodes and the odd-numbered common sustaining electrodes.

4. A driving apparatus for a plasma display panel having m>1 scanning lines, comprising:

address electrodes for applying a data to be displayed, the address electrodes formed on the plasma display panel in a column direction;

m+1 scanning/sustaining electrodes spatially separated to form the m scanning lines for selecting a line to be displayed, the scanning/sustaining electrodes formed on the plasma display panel in a direction intersecting with the address electrodes;

data driving means for applying the data to the address electrodes; and scanning/sustaining electrode driving means for selecting a scanning line to be displayed, applying a scanning pulse to a scanning electrode on the selected line to cause an addressing discharge between the scanning electrode on the selected scanning line and the addressing electrode, and supplying a sustaining pulse to cause a sustaining discharge between the scanning electrode on the selected scanning line and a scanning electrode on a scanning line adjacent to the selected scanning line in a predetermined time interval.

5. The driving apparatus as claimed in claim 4, wherein said scanning/sustaining electrode driving means comprises:

a first scanning/sustaining driver for driving each of (4k+1)th scanning/sustaining electrodes (wherein k is an integer satisfying a relationship of $0 \leqq k < (m-4)/4$);

a second scanning/sustaining driver for driving each of (4k+2)th scanning/sustaining electrodes;

a third scanning/sustaining driver for driving each of (4k+3)th scanning/sustaining electrodes; and a fourth scanning/sustaining driver for driving each of (4k+4)th scanning/sustaining electrodes.

6. The driving apparatus as claimed in claim 5, wherein said first scanning/sustaining driver and said second scanning/sustaining driver apply an inverse phase of sustaining pulses to the (4k+1)th scanning/sustaining electrode and the (4k+2)th scanning/sustaining electrode.

7. The driving apparatus as claimed in claim 5, wherein said third scanning/sustaining driver and said fourth scanning/sustaining driver apply an inverse phase of sustaining pulse to the (4k+3)th scanning/sustaining electrode and the (4k+4)th scanning/sustaining electrode.

8. The driving apparatus as claimed in claim 4, wherein said scanning/sustaining electrode driving means applies a multiple step of sustaining pulse having a phase difference to the scanning/sustaining electrode lines to make a sustaining discharge of the scanning/sustaining electrode lines included in the adjacent scanning lines.

9. The driving apparatus as claimed in claim 4, wherein said scanning/sustaining electrode drivingmeans applies a desired level of block signal for preventing a misdischarge between the adjacent scanning lines to a specified scanning line.

10. The driving apparatus as claimed in claim 9, wherein said block signal has a level value between a high level and a low level of the sustaining pulse.

11. The driving apparatus as claimed in claim 4, wherein said scanning/sustaining electrode driving means comprises:

a first scanning/sustaining driver for driving each of (3k+1)th scanning/sustaining electrodes (wherein k is an integer satisfying a relationship of $0 \leqq k < (m-3)/3$);

a second scanning/sustaining driver for driving each of (3k+2)th scanning/sustaining electrodes; and a third scanning/sustaining driver for driving each of (3k+3)th scanning/sustaining electrodes.

12. The driving apparatus as claimed in claim 11, herein a multiple step of sustaining pulses phase-delayed sequentially are applied by said first to third scanning/sustaining drivers.

13. The driving apparatus as claimed in claim 11, wherein said third scanning/sustaining driver applies a desired level of block signal for preventing a misdischarge between the (3k+1)th scanning/sustaining electrodes and the (3k+2)th scanning/sustaining electrodes to the (3k+3)th scanning/sustaining electrodes.

14. The driving apparatus as claimed in claim 4, wherein said display panel further comprises a dummy electrode for causing a sustaining discharge along with the scanning/sustaining electrode included in a first one of the m scanning lines.

15. The driving apparatus as claimed in claim 14, wherein said scanning/sustaining electrode driving means comprises:

a first scanning/sustaining driver for driving each of the (3k+1)th scanning/sustaining electrodes (wherein k is an integer satisfying a relationship of $0 \leqq k < (m-3)/3$);

a second scanning/sustaining driver for driving each of the (3k+2)th scanning/sustaining electrodes; and a third scanning/sustaining driver for driving the dummy electrode and each of the (3k+3)th scanning/sustaining electrodes.

16. The driving apparatus as claimed in claim 15, wherein said first scanning/sustaining driver applies a desired level of block signal for preventing a misdischarge between the (3k+1)th scanning/sustaining electrodes and the (3k+3)th scanning/sustaining electrodes including the dummy electrode to the (3k+1)th scanning/sustaining electrodes.

17. A method of driving for a plasma display panel having m>1 scanning lines including address electrodes for applying a data and m+1 scanning/sustaining electrodes spatially separated to form the m scanning lines for selecting a line, the scanning/sustaining electrodes formed on the plasma display panel in a direction intersecting with the address electrodes, comprising the steps of applying the data to the address electrodes and selecting a scanning line to be displayed to cause an addressing discharge between the scanning electrode on the selected scanning line and the addressing electrode; and supplying a sustaining pulse to cause a sustaining discharge between the scanning electrode on the selected scanning line and a scanning electrode on a scanning line adjacent to the selected scanning line in a predetermined time interval.

18. The driving method as claimed in claim 17, herein said step of causing a sustaining discharge includes:

applying a first inverse phase of sustaining pulses to the (4k+1)th scanning/sustaining electrodes and the (4k+2)th scanning/sustaining electrodes (wherein k is an integer satisfying a relationship of $0 \leqq k < (m-4)/4$) to cause a sustaining discharge; and applying a second inverse phase of sustaining pulses to the (4k+3)th scanning/sustaining electrodes and the (4k+4)th scanning/sustaining electrodes.

19. The driving method as claimed in claim 17, said step of causing a sustaining discharge includes:

sequentially making a sustaining discharge of the scanning/sustaining electrodes included in the scanning lines within blocks including a plurality of adjacent scanning lines, and simultaneously making a sustaining discharge of the blocks.

20. The driving method as claimed in claims 17, wherein said step of causing a sustaining discharge includes:

applying a multiple step of sustaining pulses phase-delayed sequentially to the (3k+1)th, (3k+2)th and (3k+3)th scanning/sustaining electrodes (wherein k is an integer satisfying a relationship of $0 \leqq k < (m-3)/3$) included in each of the blocks to cause a sustaining discharge; and applying a block signal for preventing a misdischarge between the (3k+1)th scanning/sustaining electrodes and the (3k+2)th scanning/sustaining electrodes to the (3k+3)th scanning/sustaining electrodes.

21. The driving method as claimed in claim 17, wherein said step of causing a sustaining discharge includes:

applying a multiple step of sustaining pulses phase-delayed sequentially to the (3k+1)th, (3k+2)th and (3k+3)th scanning/sustaining electrodes (wherein k is an integer satisfying a relationship of $0 \leqq k < (m-3)/3$) included in each of the blocks to cause a sustaining discharge with respect to the display panel provided with a separate dummy electrode sustaining-discharged along with the scanning/sustaining electrodes included a first one of the m scanning lines; and applying a block signal for preventing a misdischarge between the (3k+2)th scanning sustaining electrodes and the (3k+3)th scanning/sustaining electrodes to the (3k+1)th scanning/sustaining electrodes.

22. A plasma display panel, comprising:

m electrodes spatially separated to form m−1 illumination scan lines, each of the m−1 scan lines formed in the space between a separate adjacent pair of the m electrodes; and a driver circuit that applies a number of voltages to the m electrodes, wherein m is an integer value greater than 2, and the driver circuit sequentially applies a sustaining discharge voltage across each of the m−1 adjacent pairs of the m electrodes in a separate period of m−1 or more periods occurring in a sustaining discharge cycle.

23. The plasma display panel of claim 22, further comprising:

n blocks of scan lines, each of the n blocks comprising m electrodes spatially separated to form m−1 scan lines, wherein n is an integer value greater than 1, the n blocks are formed adjacent to one another so that a first electrode from each of n−1 blocks is adjacent to a last electrode from a different group of n−1 blocks, the plasma display panel has a total of (n*m)−1 ordered scan lines and n*m ordered electrodes, and the driver circuit applies the same voltage to each of m−1 groups of n or fewer electrodes identified by $Y_i$, where $Y_i$ is the $i^{th}$ electrode group of the m−1 groups and i has a value in the range of {1, . . . m−1} and $Y_i$ contains the group of ordered electrodes identified by $Y_i(k*(m-1)+i)$, where k is an integer value having a range of {1, . . . , n}.

24. The plasma display panel of claim 22, wherein:

the driver circuit applies a separate one of m−1 signed voltage potentials to each of the m−1 adjacent pairs of the m electrodes in each of the separate periods, and the driver applies each of the m−1 voltage potentials to each of the m−1 adjacent pairs of the m electrodes in the sustaining discharge cycle.

25. The plasma display panel of claim 22, further comprising:

n blocks of scan lines, each of the n blocks comprising m electrodes spatially separated to form m−1 scan lines, wherein n is an integer value greater than 1, the n blocks are formed adjacent to one another so that a first electrode from each of n−1 blocks is adjacent to a last electrode from a different group of n−1 blocks, the plasma display panel has a total of (n*m)−1 scan lines, the driver circuit applies a separate one of m−1 signed voltage potentials to each of the m−1 adjacent pairs of the m electrodes in each of the separate periods, and the driver applies each of the m−1 voltage potentials to each of the m−1 adjacent pairs of the m electrodes in the sustaining discharge cycle.

26. A method of driving a plasma display panel that has m electrodes spatially separated to form m−1 illumination scan lines, with each of the m−1 scan lines formed in the space between a separate adjacent pair of the m electrodes, m an integer value greater than 2, and a driver circuit that applies voltages to the m electrodes, comprising:

(a) applying a sustaining discharge potential with the driver circuit across a $j^{th}$ pair of adjacent electrodes in a $j^{th}$ period of a sustaining discharge cycle;

(b) applying a non-sustaining discharge potential with the driver circuit across m−2 other pairs of adjacent electrodes in the $j^{th}$ period of the sustaining discharge cycle; and (c) repeating steps (a) and (b) m−2 times within the sustaining discharge cycle to apply the sustaining discharge potential to each $j^{th}$ pair of m−1 adjacent electrodes.

27. The method of claim 26, further comprising:

applying the same voltage to each of m−1 groups of n or fewer electrodes identified by $Y_i$, where $Y_i$ is the $i^{th}$ electrode group of the m−1 groups, i has a value in the range of {1, . . . m−1}, $Y_i$ contains the group of electrodes identified by $Y_i(k*(m-1)+i)$, and k is an integer value having a range of {1, . . . , n}, wherein the plasma display panel has n blocks of scan lines, each of the n blocks comprising m electrodes spatially separated to form m−1 scan lines, n is an integer value greater than 1, the n blocks are formed adjacent to one another so that a first electrode from each of n−1 blocks is adjacent to a last electrode from a different group of n−1 blocks, and the plasma display panel has a total of (n*m)−1 ordered scan lines and n*m ordered electrodes.

28. The plasma display panel of claim 26, further comprising:

applying a separate one of m−1 signed voltage potentials to each of the m−1 adjacent pairs of the m electrodes in each of the separate periods, and applying each of the m−1 voltage potentials to each of the m−1 adjacent pairs of the m electrodes in the sustaining discharge cycle.

29. The plasma display panel of claim 26, further comprising:

applying a separate one of m−1 signed voltage potentials to each of the m−1 adjacent pairs of the m electrodes in each of the separate periods, and applying each of the m−1 voltage potentials to each of the m−1 adjacent pairs of the m electrodes in the sustaining discharge cycle, wherein the plasma display panel has n blocks of scan lines, each of the n blocks comprising m electrodes spatially separated to form m−1 scan lines, n is an integer value greater than 1, the n blocks are formed adjacent to one another so that a first electrode from each of n−1 blocks is adjacent to a last electrode from a different group of n−1 blocks, and the plasma display panel has a total of (n*m)−1 scan lines.

* * * * *